US012736266B2

(12) United States Patent
Casa

(10) Patent No.: US 12,736,266 B2
(45) Date of Patent: Sep. 15, 2026

(54) COOLER

(71) Applicant: University of Connecticut, Farmington, CT (US)

(72) Inventor: Douglas Casa, Storrs, CT (US)

(73) Assignee: UNIVERSITY OF CONNECTICUT, Farmington, CT (US)

( * ) Notice: Subject to any disclaimer, the term of this patent is extended or adjusted under 35 U.S.C. 154(b) by 0 days.

(21) Appl. No.: 19/274,120

(22) Filed: Jul. 18, 2025

(65) Prior Publication Data

US 2026/0022881 A1 Jan. 22, 2026

Related U.S. Application Data

(60) Provisional application No. 63/673,672, filed on Jul. 20, 2024.

(51) Int. Cl.
*F25D 3/00* (2006.01)

(52) U.S. Cl.
CPC ..... *F25D 3/00* (2013.01); *F25D 2201/10* (2013.01); *F25D 2303/083* (2013.01); *F25D 2327/00* (2013.01); *F25D 2400/32* (2013.01); *F25D 2400/36* (2013.01); *F25D 2400/38* (2013.01); *F25D 2700/12* (2013.01)

(58) Field of Classification Search
CPC ..... F25D 3/00; F25D 3/06; F25D 3/08; F25D 23/026; F25D 2201/10; F25D 2303/083; F25D 2327/00; F25D 2400/32; F25D 2400/36; F25D 2400/38
See application file for complete search history.

(56) References Cited

U.S. PATENT DOCUMENTS

| | | | | |
|---|---|---|---|---|
| 4,759,467 | A * | 7/1988 | Byrne | F25D 23/066 220/495.08 |
| 6,895,778 | B1 | 5/2005 | Ackerman | |
| 7,143,709 | B2 | 12/2006 | Brennan et al. | |
| 7,861,892 | B1 * | 1/2011 | White | F25D 3/08 222/608 |
| 8,256,242 | B1 | 9/2012 | Evans | |
| 2018/0274837 | A1 * | 9/2018 | Christensen | B62B 5/067 |
| 2020/0247602 | A1 * | 8/2020 | Aminoff | B65D 25/04 |
| 2022/0282096 | A1 * | 9/2022 | Farrugia | C09D 135/02 |

OTHER PUBLICATIONS

Vevor; "Vevor Insulated Food Pan Carrier, 36Qt Capacity, Stackable Catering Hot Box w/ 3 Stainless Steel Pans, Top Load LLDPE Food Warmer w/Elastic Side Handles and Buckles, for Restaurant Canteen, Black"; Accessed on Jul. 15, 2025. https://www.vevor.com.

* cited by examiner

*Primary Examiner* — Joseph F Trpisovsky
(74) *Attorney, Agent, or Firm* — CANTOR COLBURN LLP

(57) ABSTRACT

A personal use cooler includes a cooler body having three chambers, each having an open end. Each of the chambers includes a respective lid movable relative to the cooler body. Each of the chambers is sealed when a respective lid is in the closed position. A drain is provided for draining a respective one of the chambers. At least one of the chambers is configured for personal use to minimize hygienic risk.

20 Claims, 16 Drawing Sheets

COOLER

CROSS REFERENCE TO RELATED APPLICATIONS

This application is filed under 35 U.S.C. § 111(a) and claims the benefit of priority under 35 U.S.C. § 119(e) to U.S. Provisional Patent Application No. 63/673,672, filed on Jul. 20, 2024, entitled "Cooler," the entire contents of which are hereby incorporated by reference.

BACKGROUND OF THE INVENTION

1. Field of the Invention

The invention disclosed herein relates to personal use accessories, and in particular to a cooler for cooling personal consumables.

2. Description of the Related Art

Many people are frequently exposed to hot conditions. Consider for example, athletes training and competing in the heat of the summer, occupational workers of all types such as construction, farming, oil & gas, road/bridge construction and many others that work outside in what are often extreme conditions. For these individuals, adequate cooling and hydration is crucially important.

Cooling and hydration may be achieved through various means. Of course, the most common and perhaps effective technique is to have an adequate supply of cold water for drinking. Additionally, a commonly used technique for lowering the body temperature is to make use of cold-wetted garments such as shirts, sleeves, hats, gators, helmet liners, bandannas, and towels.

When working in remote locations, it is important to make efficient use of a limited supply of water. For example, when wetting a shirt with cold water, it is best to soak the shirt in a supply of water (or reservoir) rather than just pouring water over the shirt. In this manner, no water is lost in the process of rejuvenation of the cooling garment. As one can imagine, rewetting of garments soaked with sweat calls for personal water supplies.

What are needed are methods and apparatus that provide individuals with cooling capacity for sustained periods in extreme heat.

SUMMARY OF THE INVENTION

According to an embodiment, a personal use cooler includes a cooler body having three chambers, each having an open end. Each of the chambers includes a respective lid movable relative to the cooler body. Each of the chambers is sealed when a respective lid is in the closed position. A drain is provided for draining a respective one of the chambers. At least one of the chambers is configured for personal use to minimize hygienic risk.

In addition to one or more of the features described above, or as an alternative, in further embodiments the cooler body includes a hollow interior and a plurality of dividers are arranged within the hollow interior to define the plurality of chambers.

In addition to one or more of the features described above, or as an alternative, in further embodiments at least one of the lids is pivotably coupled to the cooler body.

In addition to one or more of the features described above, or as an alternative, in further embodiments each of the lids is independently movable relative to the cooler body.

In addition to one or more of the features described above, or as an alternative, in further embodiments a cover is positionable in overlapping arrangement with the lids in the closed position.

In addition to one or more of the features described above, or as an alternative, in further embodiments at least one of a dispensing mechanism and an inlet port.

In addition to one or more of the features described above, or as an alternative, in further embodiments a plurality of wheels coupled to the cooler body.

In addition to one or more of the features described above, or as an alternative, in further embodiments at least one handle arranged at an exterior of the cooler body.

In addition to one or more of the features described above, or as an alternative, in further embodiments at least one mounting feature and a strap, the strap being connectable to the at least one mounting feature.

In addition to one or more of the features described above, or as an alternative, in further embodiments an interior at least one of the chambers includes a coating or pattern configured to limit bacterial growth.

According to an embodiment, a personal user cooler includes a cooler body having three chambers. The three chambers are fluidly separate from one another. Each of the chambers includes a respective lid movable relative to the cooler body. Each of the chambers is sealed when a respective lid is in the closed position. Three drains are provided for draining a respective one of the chambers. An inlet port for filling a respective one of the chambers is fluidly connectable to a fluid source located remotely from the cooler when the respective one of the chambers is closed by the respective lid.

In addition to one or more of the features described above, or as an alternative, in further embodiments each of the lids is independently movable relative to the cooler body.

In addition to one or more of the features described above, or as an alternative, in further embodiments at least one of the lids is pivotably coupled to the cooler body.

In addition to one or more of the features described above, or as an alternative, in further embodiments at least one of the lids is removably connectable to the cooler body.

In addition to one or more of the features described above, or as an alternative, in further embodiments each of the lids includes a gasket.

In addition to one or more of the features described above, or as an alternative, in further embodiments a plurality of wheels are coupled to the cooler body.

In addition to one or more of the features described above, or as an alternative, in further embodiments at least one handle arranged at an exterior of the cooler body.

In addition to one or more of the features described above, or as an alternative, in further embodiments at least one mounting feature and a strap. The strap is connectable to the at least one mounting feature.

In addition to one or more of the features described above, or as an alternative, in further embodiments a disposable liner is receivable within one of the three chambers.

According to an embodiment, a personal use cooler includes a cooler body having three chambers. Each of the chambers has an open end and each of the chambers has a respective lid movable relative to the cooler body. Each of the chambers is sealable by the respective lid. A drain for draining is provided for draining a respective one of the chambers. At least one of the chambers is configured for personal use to minimize hygienic risk and an interior at least one of the chambers has anti-microbial properties intended to limit bacterial growth.

BRIEF DESCRIPTION OF THE DRAWINGS

The features and advantages of the invention are apparent from the following description taken in conjunction with the accompanying drawings in which.

DETAILED DESCRIPTION OF THE INVENTION

Figure 1B:
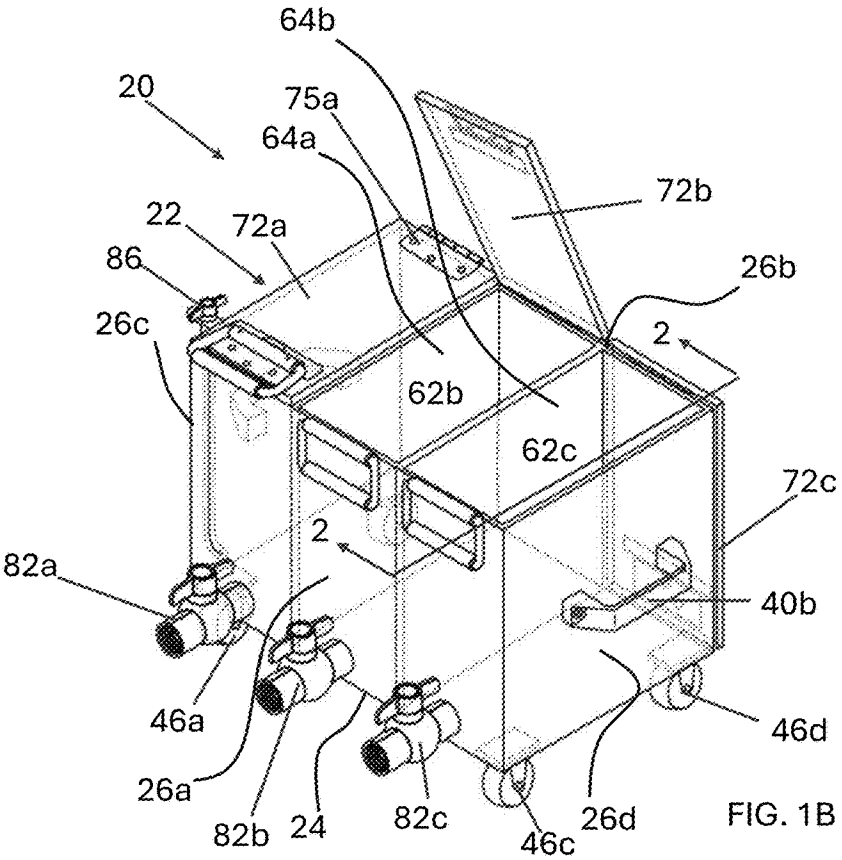
FIG. 1B is a perspective view of the cooler of FIG. 1A with some of the plurality of lids in an open position.
Figure 1A:
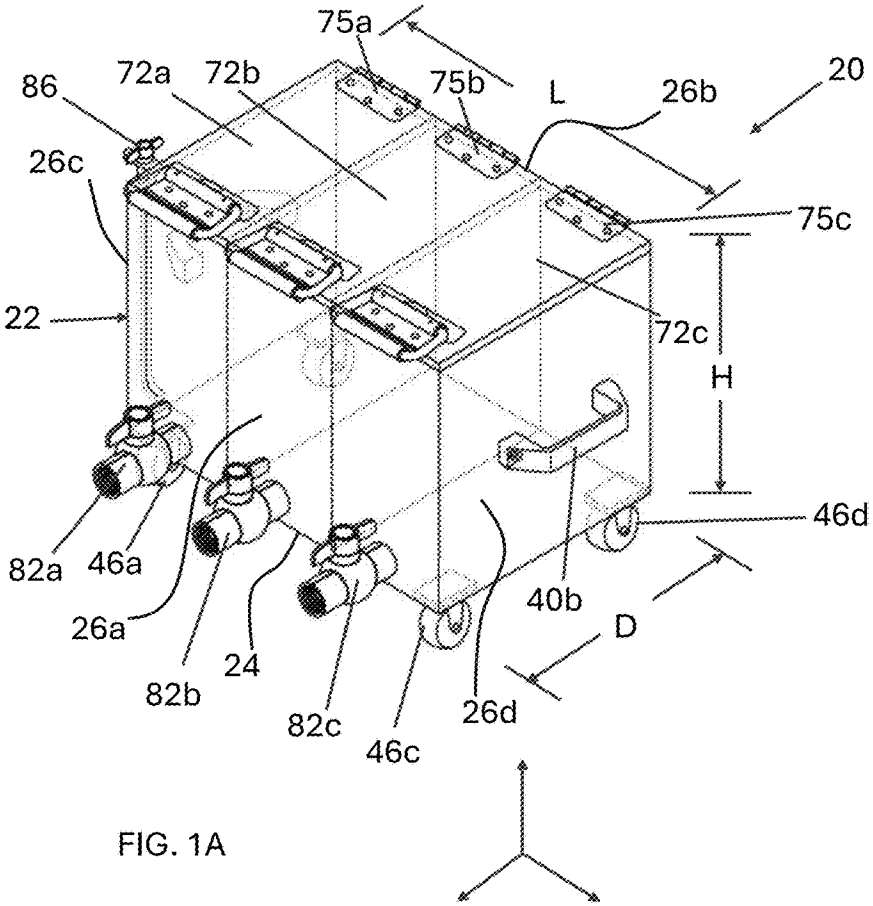
FIG. 1A is a perspective view of a cooler having a plurality of lids in a closed position.

Disclosed herein are embodiments of personalized coolers. Generally, a personalized cooler (also referred to herein as a "cooler") according to the embodiments disclosed herein includes a series of chambers. In the various embodiments provided herein the cooler includes three chambers. Generally, the three chambers include a drinking chamber, a cooling chamber, and a rewetting chamber.

Generally, the personal use coolers herein are adapted for preserving hygienic conditions. That is, by dedicating each cooler to use by one individual, users (such as employers, teams, and other parties) can avoid spreading germs through shared apparatus, while also providing a cooler that is a valuable resource in hot environments. Accordingly, embodiments of the cooler as described herein provide users with a personal use resource to assist with maintaining hydration without exposure to hygienic risk.

That is, sharing a drinking station presents a hygienic risk due to the potential for cross-contamination between users. When multiple individuals come into contact with the same surfaces-such as spigots, cups, or bottle fill areas-bacteria, viruses, and other pathogens can be transferred through saliva, skin contact, or airborne droplets. If the station is not regularly sanitized or lacks proper drainage and touchless features, these pathogens can accumulate and spread, increasing the likelihood of transmitting illnesses such as colds, flu, gastrointestinal infections, or more serious communicable diseases. Thus, embodiments of the personal use cooler as introduced herein help to minimize that risk.

For example, in some embodiments, interior surfaces of the cooler may be treated with appropriate chemicals for maintaining sanitary conditions. In some embodiments, surfaces of the cooler are patterned with a micropattern that reduces bacterial growth. One example of source of such technology includes various embodiments available through Sharklet Technologies, Inc. of Aurora, Colorado. More specifically, one example is provided in U.S. Pat. No. 7,143,709, entitled "Surface topography for non-toxic bioadhesion control" and incorporated herein by reference. This reference discloses techniques for controlling surface topography for resisting bioadhesion.

As shown, the cooler 20 includes a cooler body 22 having a bottom wall 24 or first closed end and a plurality of sidewalls extending from the bottom wall 24. The plurality of sidewalls may have similar or varying configurations, such as size and shape for example. In an embodiment, the cooler may be provided in a form that is substantially box-like. In the non-limiting embodiment illustrated in FIGS. 1A-3, the plurality of sidewalls extending from the bottom wall 24 includes a front wall 26*a*, a rear wall 26*b*, a first lateral sidewall 26*c*, and a second lateral sidewall 26*d*. As shown, the front wall 26*a* and the rear wall 26*b* may be located proximate front and rear opposing edges of the bottom wall 24. The first lateral sidewall 26*c* may be arranged near a first lateral edge of the bottom wall 24 and may extend between and connect a first end of the front wall 24*a* and the rear wall 26*b*, respectively. Similarly, the second lateral sidewall 26*d* may be arranged near a second lateral edge of the bottom wall 24, opposite the first lateral edge, and may extend between and connect a second end of the front wall 24*a* and the rear wall 24*b*, respectively. In the illustrated, non-limiting embodiment, each of the plurality of sidewalls 26*a*, 26*b*, 26*c*, 26*d* has a generally orthogonal orientation relative to the adjacent sidewalls 26*a*, 26*b*, 26*c*, 26*d* and the bottom wall 24 of the cooler body 22. In such embodiments, the exterior of the cooler body 22 is shaped like a rectangular prism.

The cooler body 22 has a length L measured along a first axis, such as extending between the first and second lateral sidewalls 26*c*, 26*d*, a depth D measured along a second axis, such as extending between the front wall 26*a* and the rear wall 26*b*, and a height H measured along a third axis, perpendicularly from the bottom wall. The second axis is oriented perpendicular to the first axis, and the third axis is oriented perpendicular to both the first axis and the second axis. In embodiments where an exterior of the cooler 20 is substantially box-like, a length L of the cooler body 22 may be equal to or greater than a depth D of the cooler body 22 and may be equal to or greater than a height H of the cooler body 22. However, embodiments where the height H is greater than the length L and/or depth D and embodiments where the depth D is greater than the length L and/or height H (see FIG. 3) are also contemplated herein.

Figure 2B:
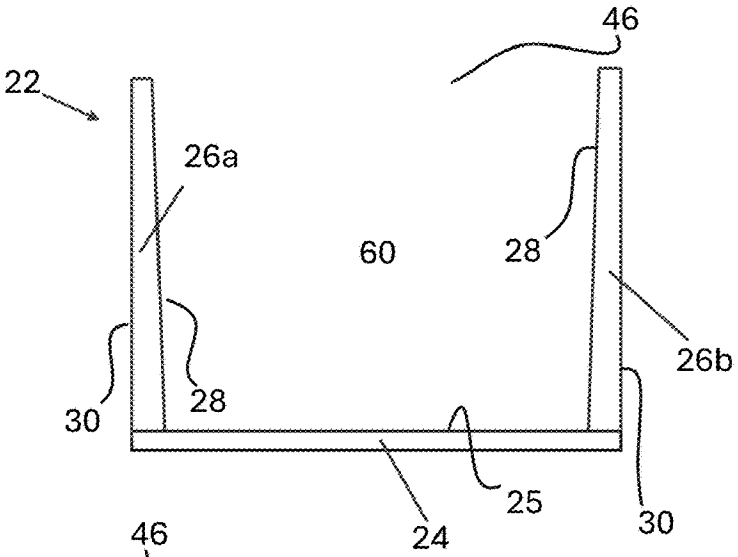
FIG. 2B is a cross-sectional view of the cooler body of FIG. 1B.
Figure 2C:
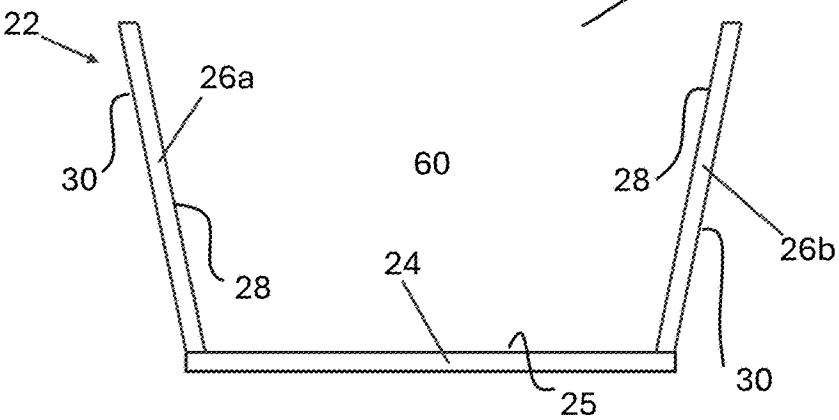
FIG. 2C is a cross-sectional view of the cooler body of FIG. 1B.
Figure 2A:
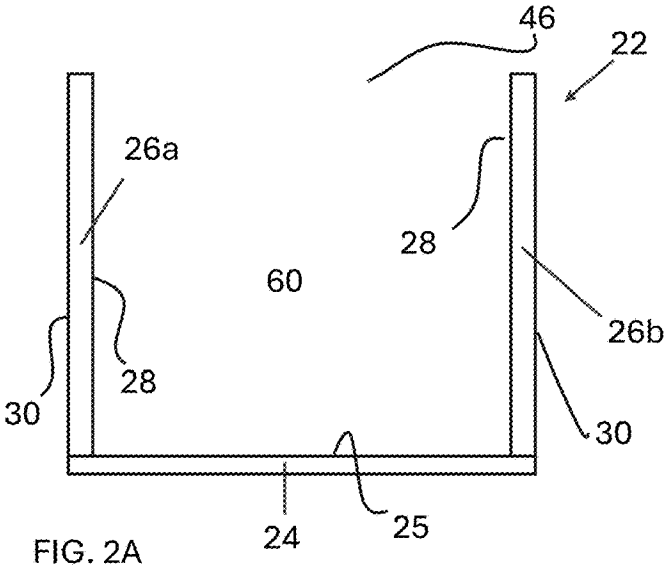
FIG. 2A is a cross-sectional view of the cooler body of FIG. 1B.

With reference to the cross-sectional views of the cooler body 22 shown in FIGS. 2A-2D, it should be appreciated that each of the plurality sidewalls 26*a*, 26*b*, 26*c*, 26*d* has an interior surface 28 and an exterior surface 30. In the illustrated, non-limiting embodiment of FIGS. 2A and 2B, the interior surface 28 and the exterior surface 30 of each sidewall 26*a*, 26*b*, 26*c*, 26*d* are shown parallel to one another. In some embodiments, both the interior surface 28 and the exterior surface 30 of each sidewall 26*a*, 26*b*, 26*c*, 26*d* are arranged perpendicular to the bottom wall 24 (FIG. 2A). In embodiments where both the interior surface 28 and the exterior surface 30 of each of the plurality of sidewalls 26*a*, 26*b*, 26*c*, 26*d* are arranged perpendicular to the bottom wall 24, both an external cross-sectional area of the cooler body 22 and an internal cross-sectional area of the cooler body 22 is constant over the height H of the cooler body 22. However, embodiments where the interior surface 28 of one or more of the sidewalls 26*a*, 26*b*, 26*c*, 26*d* is arranged at another angle relative to an exterior surface 30 of the sidewall 26*a*, 26*b*, 26*c*, 26*d*, as shown in FIG. 2B, are also within the scope of the disclosure. Accordingly, a cross-sectional shape defined by the interior surfaces 28 of the sidewalls 26*a*, 26*b*, 26*c*, 26*d* may be different than a cross-sectional shape defined by the exterior surfaces 30 of the sidewalls 26*a*, 26*b*, 26*c*, 26*d* of the cooler body 22.

Although the various embodiments of a cooler 20 illustrated and described in FIGS. 1A-6 have a rectangular body, it should be appreciated that in other embodiments, the cooler body 22 may have various form factors resulting in the cooler 20 having other appearances. For example, a cooler body 22 having another shape, such as a crescent shape or cylindrical shape, is also contemplated herein. In an embodiment, one or more of the sidewalls 26*a*, 26*b*, 26*c*, 26*d* of the cooler body 22 may be arranged at an angle relative to the bottom wall 24 of the cooler body 22, as shown in FIG. 2C. In such embodiments, a cross-sectional area of the cooler body 22 may vary over a height of the cooler body 22. It should further be appreciated that neither the size nor geometry of the cooler body 22 is limiting, and other configurations are within the scope of the disclosure.

Further, embodiments including a cooler body 22 having fewer or greater than four sidewalls are within the scope of the disclosure. The number of sidewalls of the cooler body 22 may be determined by the configuration of the sidewalls, such as the size and shape of each sidewall. In the non-limiting embodiment of FIGS. 13A and 13B, the cooler body 22 includes a bottom wall 24, and a first and second sidewall 26*a*, 26*b* extending from the bottom wall 24. As shown, the first and second sidewalls 26*a*, 26*b* are curved about an axis such that the lateral edges of the first and second sidewall 26*a*, 26*b* are connected to one another. In an embodiment, the curvature of the first and second sidewalls 26*a*, 26*b* results in the cooler 20 being generally crescent shaped. The curvature of one or more of the sidewalls 26*a*, 26*b* may define a recess or area 31 sized to accommodate the body of an individual carrying the cooler 20, such as via a shoulder strap for example.

The cooler 20 may include one or more features to enhance the portability of the cooler 20. For example, the cooler 20 may have at least one handle 40*a*, 40*b*, and in some embodiments includes a plurality of handles 40*a*, 40*b* at a position offset from a support surface to facilitate carrying or moving the cooler 20. The one or more handles 40*a*, 40*b* may be arranged at any suitable location about an exterior of the cooler body 22. In an embodiment, the cooler includes a pair of substantially identical handles 40*a*, 40*b*, such as one on each of two opposing sides of the cooler body. In the illustrated, non-limiting embodiment, a first handle 40*a* is arranged at the first lateral sidewall 26*c* and a second handle 40*b* is arranged at the second lateral sidewall 26*d*. However, embodiments including a plurality of handles 40*a*, 40*b* arranged at the same sidewall or at adjacent sides of the cooler body 22 are also within the scope of the disclosure. Further, embodiments where one or more handles 40*a*, 40*b* are arranged at any of the lids 72*a*, 72*b*, 72*c*, cover 80 and/or the bottom wall 24 of the cooler body 22 are also within the scope of the disclosure.

The one or more handles may have a unitary body, may be a multipart handle, or may have any other suitable configuration. In embodiments including at least one handle 40*a*, 40*b*, the at least one handle 40*a*, 40*b* may be stationary relative to the cooler body 22 or may be movable relative to the cooler body 22 (see FIGS. 6 and 7 in which the handle is rotatably coupled to the cooler body 22). In embodiments where a handle 40*a*, 40*b* is stationary, the handle 40*a*, 40*b* may be integrally formed with the cooler body 22. In such embodiments, the at least one handle 40*a*, 40*b* may be a protrusion that extends outwardly from an exterior surface 30 of a sidewall 26*a*, 26*b*, 26*c*, 26*d* the cooler body 22 or may be a recess formed in an exterior surface 30 of a sidewall 26*a*, 26*b*, 26*c*, 26*d* of the cooler body 22. In some embodiments, the handle 40*a*, 40*b* is removably connectable to the cooler 20 such that the handle 40*a*, 40*b* is attached to the cooler body 22 in the use position and is separated or disconnected from the cooler body 22 in the non-use position. In embodiments where the handles 40*a*, 40*b* are formed separately from the cooler body 22, the at least one handle 40*a*, 40*b* is connected to the cooler body 22 at a single attachment location, or alternatively, at multiple attachment locations spaced apart from one another.

In embodiments where a handle 40*a*, 40*b* is movably coupled to the cooler body 22, the handles 40*a*, 40*b* may be translatable, rotatable, or movable in any other suitable manner relative to the cooler body 22 between a stowed or non-use position and a use position. In the use position, the handle 40*a*, 40*b* may be oriented at an angle relative to the adjacent surface of the cooler body 22. In the stowed position, the handle 40*a*, 40*b* may be oriented generally parallel to an adjacent surface of the cooler body 22.

Figure 9:
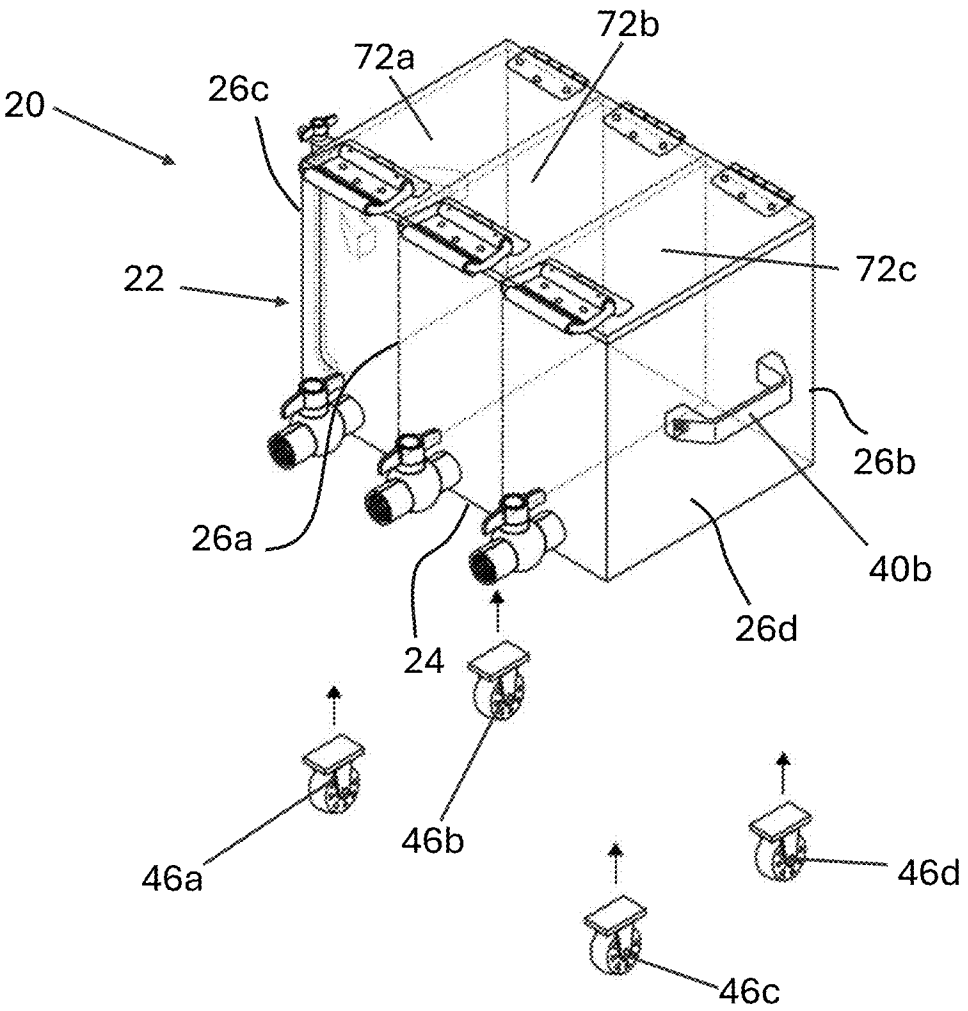
FIG. 9 is a perspective exploded view of a cooler body and a plurality of wheels connectable to a bottom of the cooler body.
Figure 10:
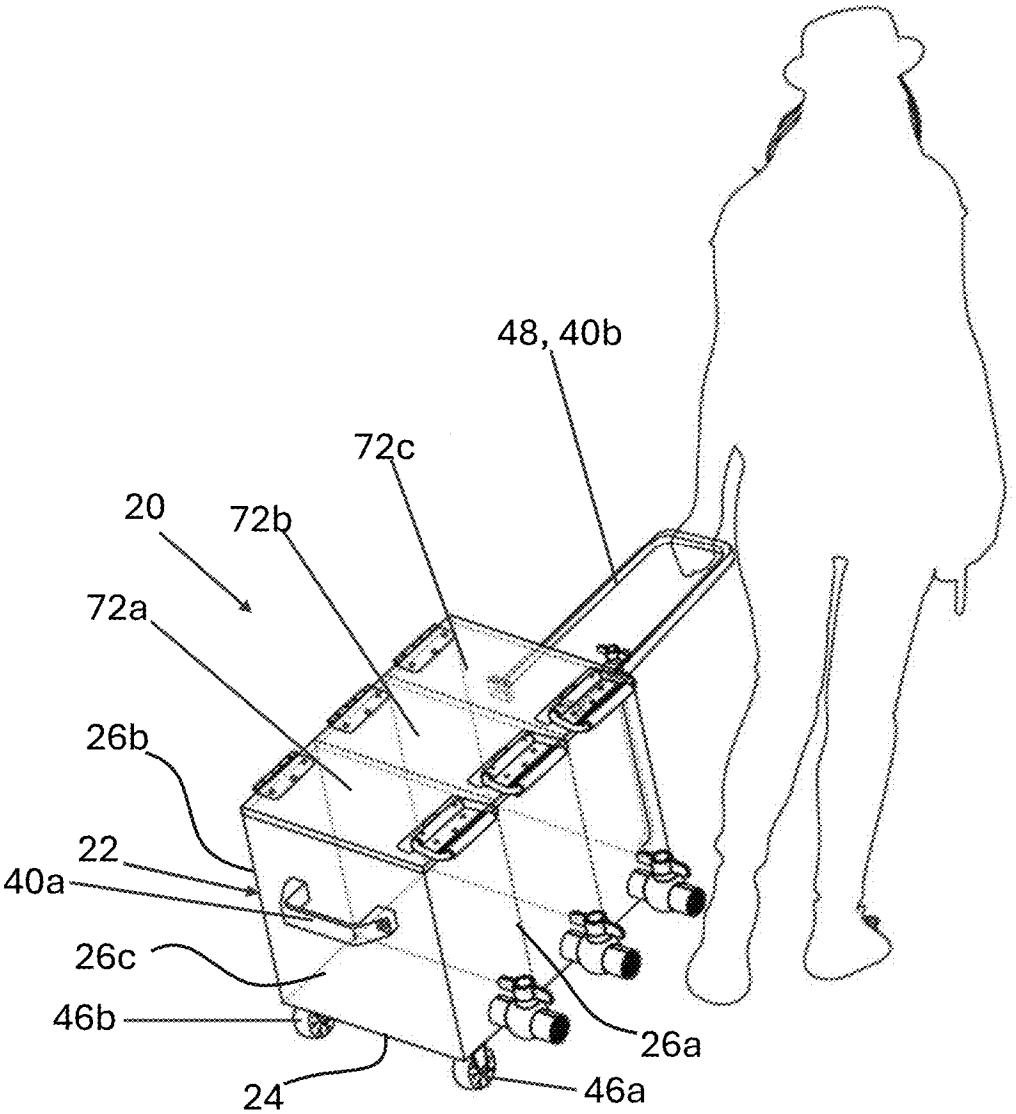
FIG. 10 is a perspective view of a cooler during transport via application of a pulling force by a user.
Figure 11B:
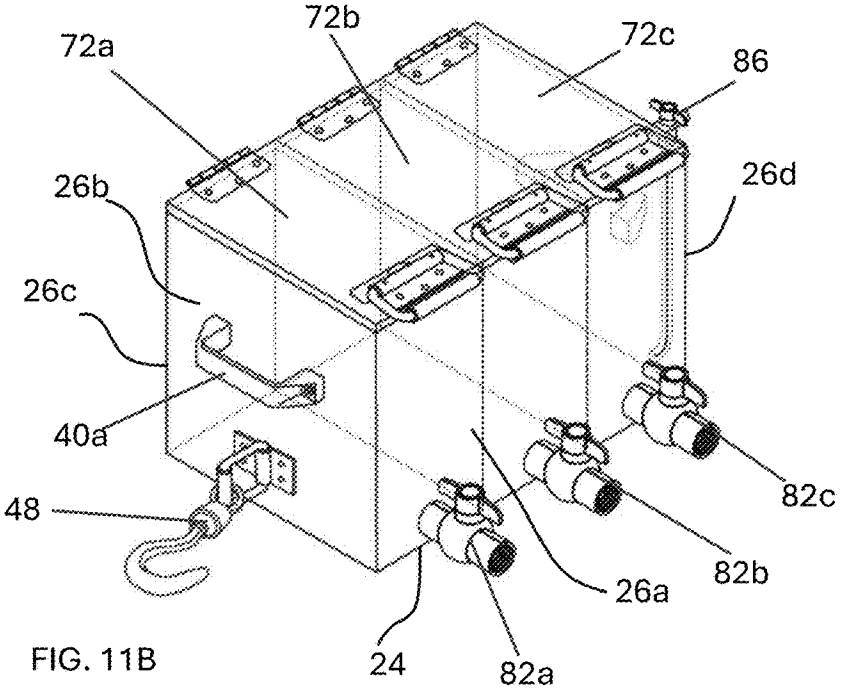
FIG. 11B is a perspective view of a cooler having a tow device.
Figure 11A:
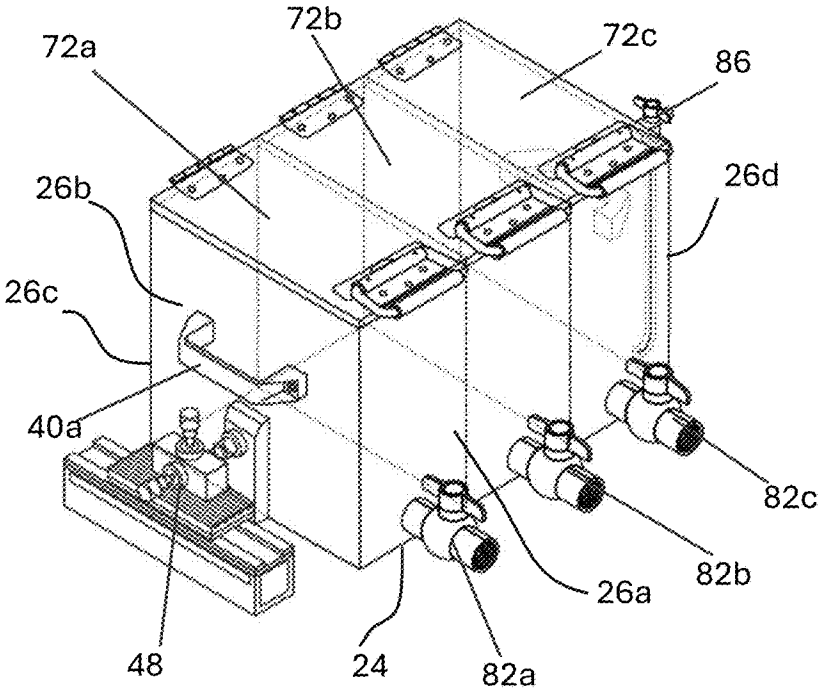
FIG. 11A is a perspective view of a cooler having a tow device.

In some embodiments, the cooler 20 may include wheels such that it may be easily rolled around at a facility or transported from one location to another. As shown, a plurality of wheels 46*a*, 46*b*, 46*c*, 46*d* may be arranged about the cooler body 22 (see FIG. 9). In such embodiments, one or more of the wheels 46*a*, 46*b*, 46*c*, 46*d* may be standard wheels rotatable about a single axis, or alternatively, may be caster wheels rotatable about two perpendicularly oriented axes relative to the cooler body 22. In an embodiment, the plurality of wheels includes four wheels 46*a*, 46*b*, 46*c*, 46*d* arranged at the bottom wall 24, one proximate each corner thereof. In other embodiments, such as shown in FIG. 10, two wheels 46*a*, 46*b* are mounted to the bottom wall 24 of the cooler body 22, such as proximate an interface between the bottom wall 24 and one of the plurality of sidewalls 26*a*, 26*b*, 26*c*, 26*d*. It should be appreciated that embodiments of the cooler 20 having any suitable number of wheels, or alternatively no wheels, are within the scope of the disclosure.

In embodiments where the cooler body 22 includes a plurality of wheels 46*a*, 46*b*, 46*c*, 46*d*, the cooler body 22 may have a tow device 48 to accommodate dragging of the cooler 20. Examples of a suitable tow device, include but are not limited to a handle, a tow hook, and a tow rope for example. In embodiments where the tow device 48 is a handle, one of the handles 40*a*, 40*b* positioned about the cooler body 22 as previously described herein may form the tow device 48. However, embodiments where a handle functioning as the tow device is separate from the handles 40*a*, 40*b* are also within the scope of the disclosure. The tow device 48 is operable to transmit a pulling force to the cooler body 22, causing the wheels 46*a*, 46*b*, 46*c*, 46*d* to rotate for movement thereof. In embodiments where two wheels 46*a*, 46*b*, 46*c*, 46*d* are arranged at the bottom wall 24 proximate a same sidewall 26*a*, 26*b*, 26*c*, 26*d*, the tow device 48 may be arranged at an opposite sidewall 26*a*, 26*b*, 26*c*, 26*d* of the cooler body 22. In an embodiment, the tow device 48 may be transformable between a use position and a non-use position. For example, the tow device 48 may be a telescoping handle (FIG. 10) that is extended when in the use position and that is retracted when in the non-use position. In embodiments where the tow device 48 is a tow handle, the tow handle may be arranged centrally relative to a respective sidewall 26*a*, 26*b*, 26*c*, 26*d* of the cooler body 22. At this central position, a user can exert an upward force on the tow handle to transform the tow handle to a non-parallel orientation relative to the support surface. With the tow handle in this upwardly angled configuration, the cooler is movable along a support surface.

In an embodiment, the cooler 20 includes at least one mounting feature, such as a hook, an interlock, embedded clip, or clip receiver for example, for anchoring the cooler 20 at a desired location. In some embodiments, the cooler 20 may be mounted to an external cradle (not shown) configured for receiving the cooler 20. This may be particularly useful in applications where the cooler 20 is arranged at the back of a vehicle, such as a line man's truck used for supporting field work on the electrical and communications infrastructure. The cooler 20 may have a single mounting feature, or in some embodiments may include a plurality of mounting features 50*a*, 50*b* For example, a first mounting feature 50*a* and a second substantially identical mounting feature 50*b* may be arranged at opposite sidewalls 26*a*, 26*b*, 26*c*, 26*d* of the cooler body 22.

Figure 6:
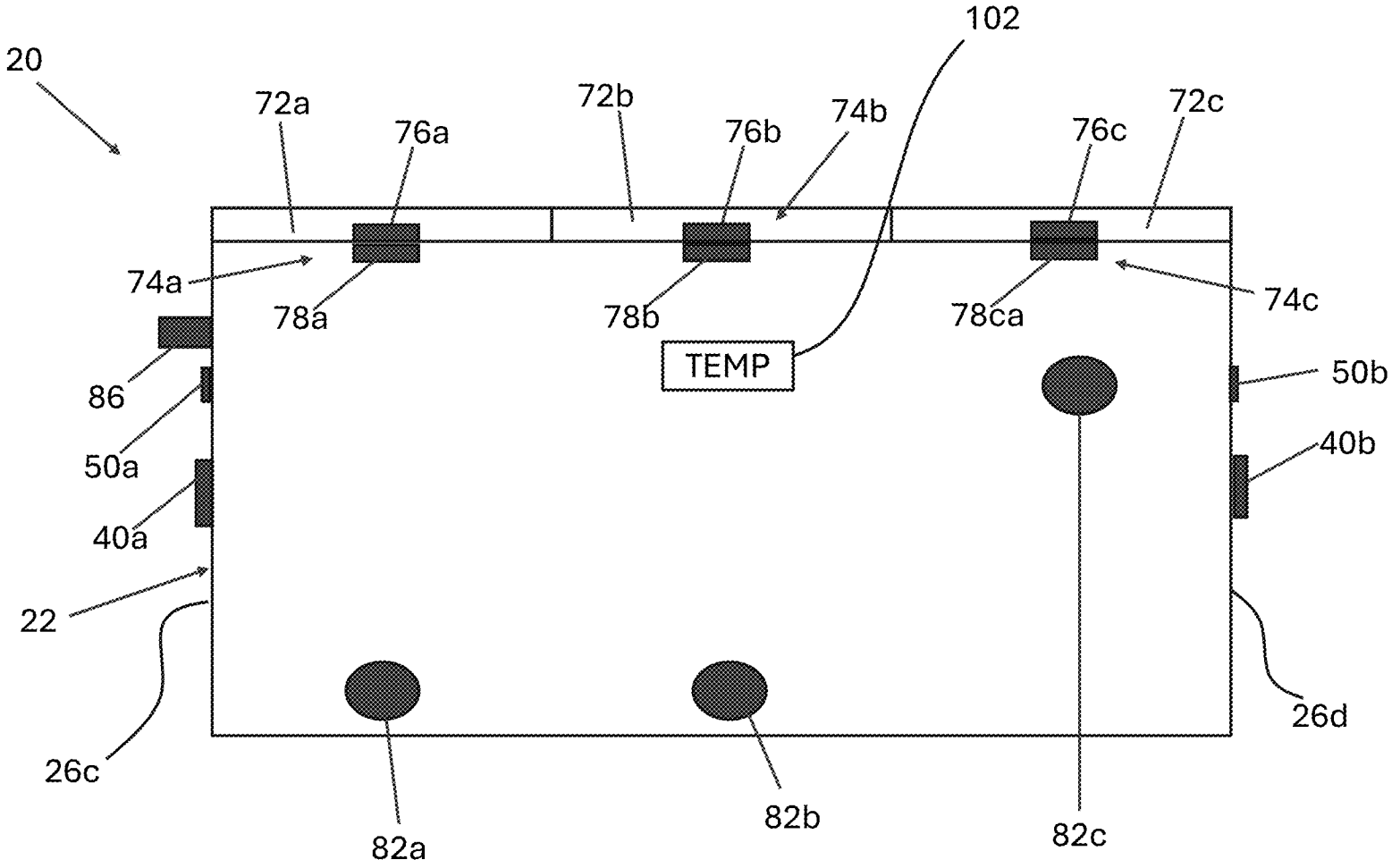
FIG. 6 is a front view of a cooler having a locking mechanism operable to retain each lid in a closed position.
Figure 7:
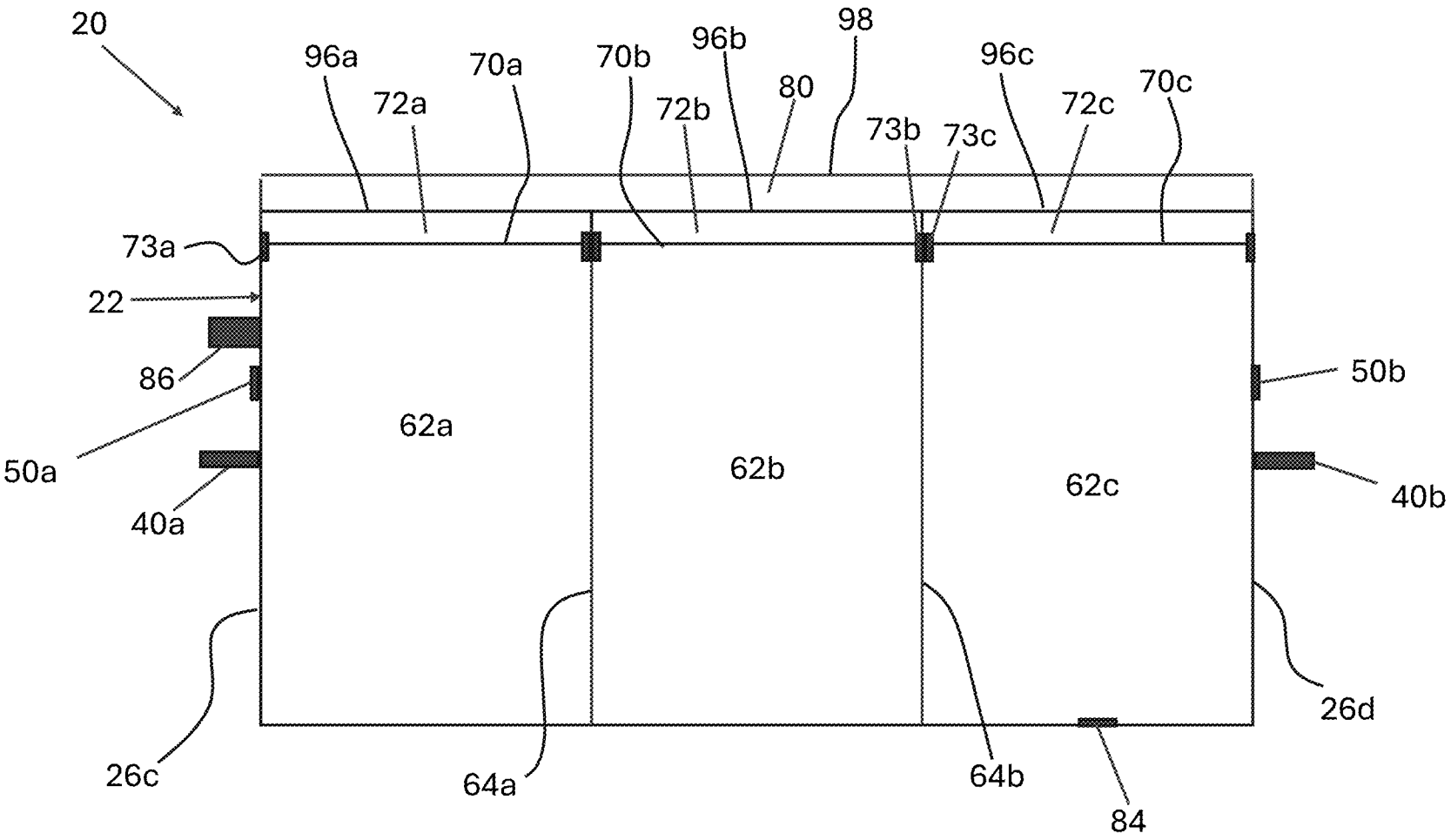
FIG. 7 is a cross-sectional view of the cooler of FIG. 6.
Figure 13B:
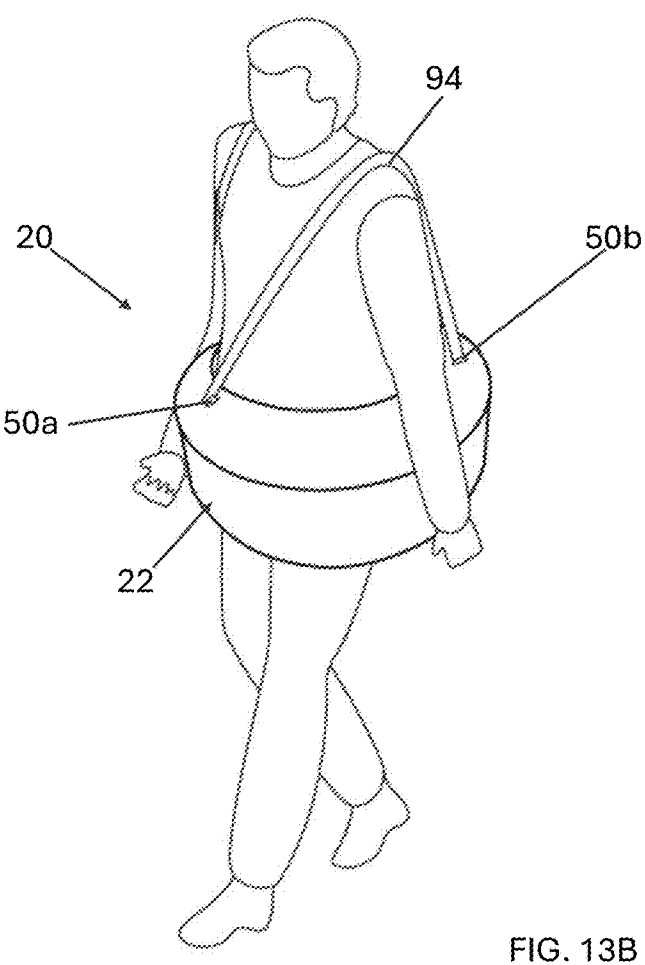
FIG. 13B is a perspective view of the cooler of FIG. 13A having a mounting strap connected to a plurality of mounting features.
Figure 13A:
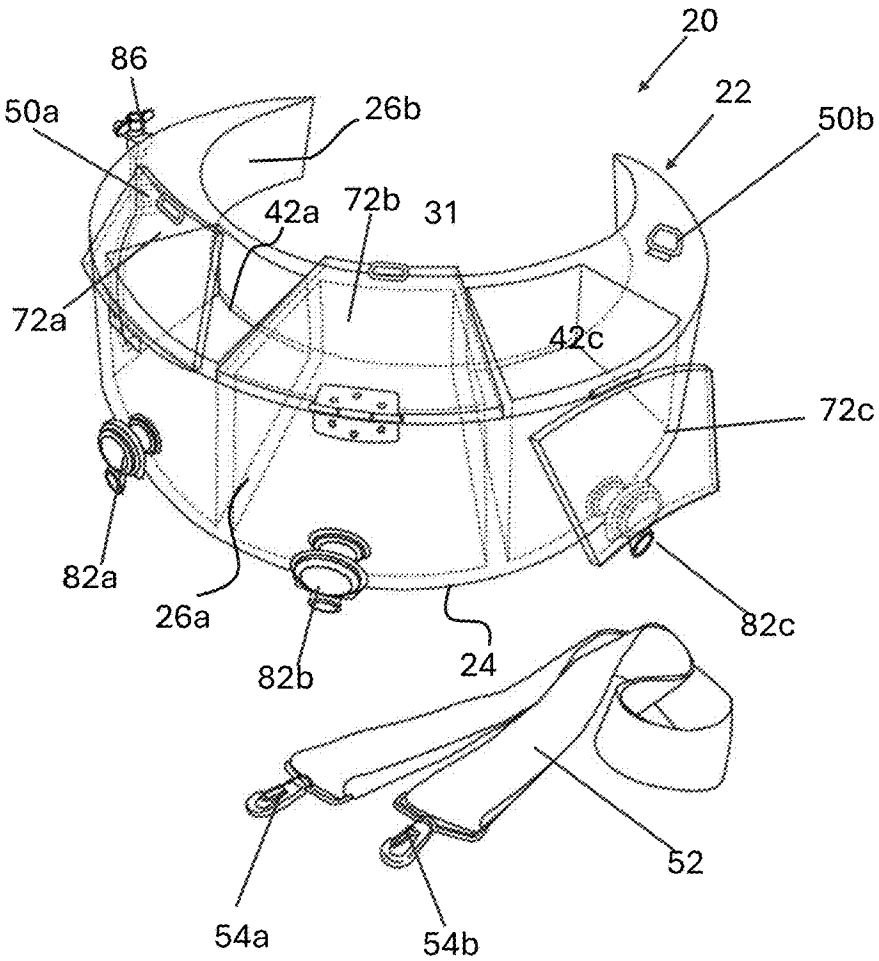
FIG. 13A is a perspective view of a cooler having an arcuate configuration.

In the non-limiting embodiment of FIGS. 6 and 7, the mounting features 50*a*, 50*b* are arranged at an exterior of the lateral sidewalls 26*c*, 26*d* of the cooler body 22. However, a mounting feature 50*a*, 50*b* located at any position about the cooler body 22, such as at the sidewalls 26*a*, 26*b*, at a top of the cooler 20, or at a lid thereof for example, are also contemplated herein. With reference to FIGS. 13A-13B, in an embodiment, one or more straps 52, are connectable to the plurality of mounting features 50*a*, 50*b*. A first end 54*a* of the strap 52 may be connectable to the first mounting feature 50*a* and a second end 54*b* of the strap 52 may be connectable to the second mounting feature 50*b*. A user may then position the strap 52 about his or her body to carry the cooler 20 more easily. It should be appreciated that the cooler 20 may be supportable in other suitable manners. For example, the cooler 20 may be integrated into a backpack, or may have a belt-mounted configuration.

The cooler body 22 may be fabricated from a variety of materials including but not limited to plastic, metal, and fabric for example. In some embodiments, the bottom wall 24 and at least one sidewall 26*a*, 26*b*, 26*c*, 26*d* may be selected such that the cooler body 22 is a substantially rigid device. In other embodiments, the cooler 20 may be a "soft" device. In embodiments where the cooler 20 is a "soft" cooler, the cooler body 22 may be a semi-rigid body, and the shape of the cooler 20 may vary based on the forces acting on the cooler 20. In addition, such a soft cooler may be collapsible to reduce the overall size of the cooler 20 for transport or stowing when not in use. In some embodiments, the cooler 20 may include fabrics which may be accompanied by other materials such as inserts. The inserts may include foam inserts configured to provide strength as well as insulative properties. It should be appreciated that the cooler body 22 may be formed via any suitable process. Examples of such processes include injection molding, blow molding, rotational molding, compression molding, thermoforming, vacuum forming, extrusion, and additive manufacturing.

Figure 2D:
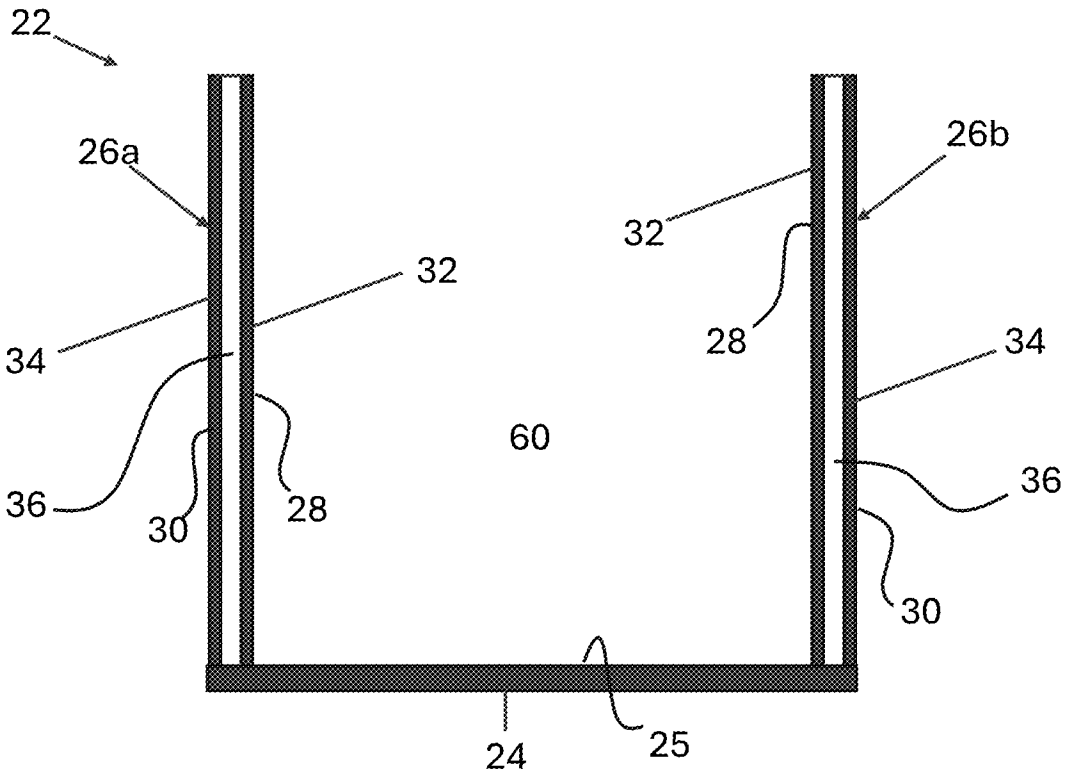
FIG. 2D is a cross-sectional view of the cooler body of FIG. 1B.
Figure 3:
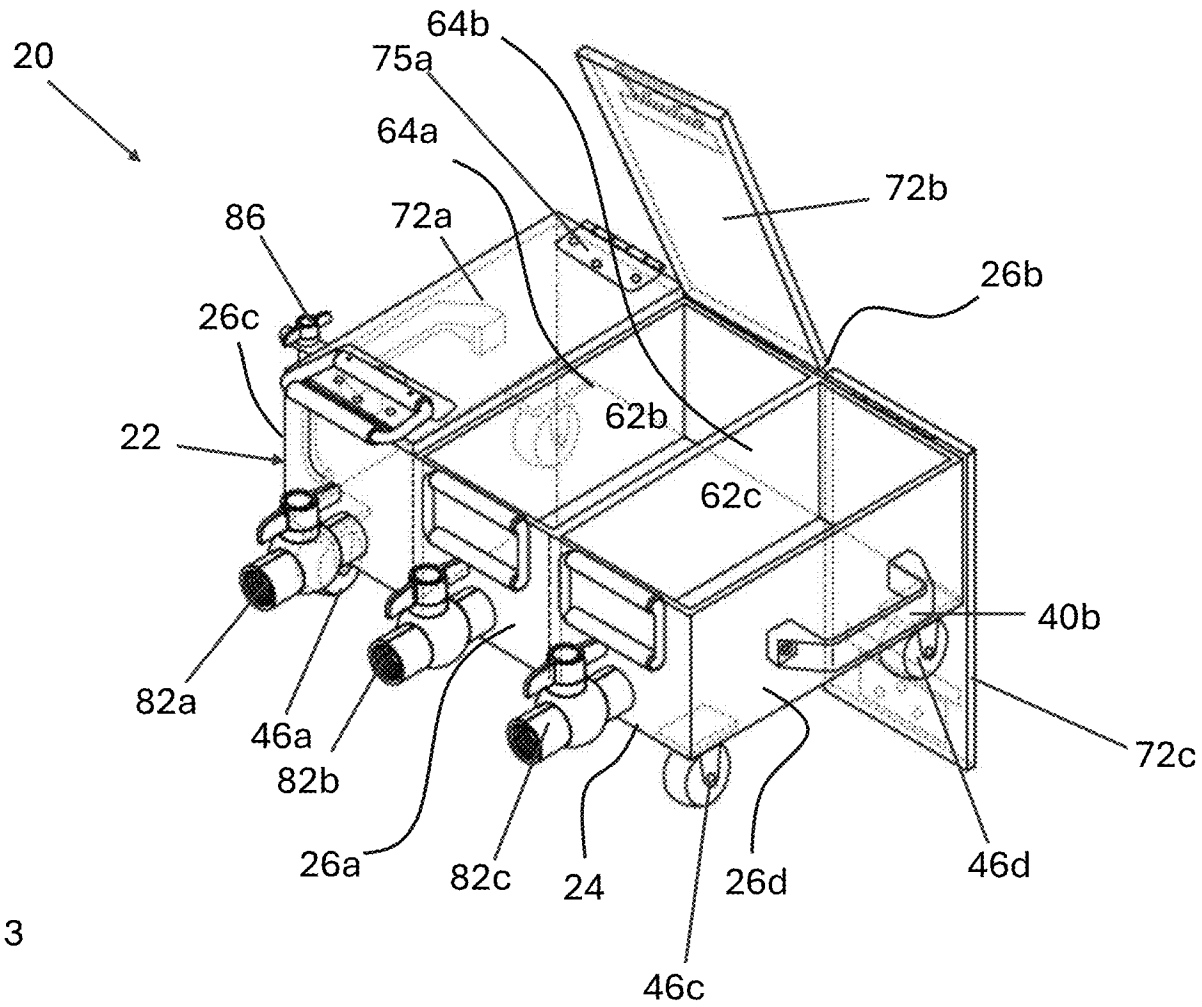
FIG. 3 is a perspective view of a cooler with some of the plurality of lids in an open position.

It should be appreciated that the cooler body 22 may be designed to restrict heat transfer therethrough. For example, the bottom wall 24 and/or one or more of the sidewalls 26*a*, 26*b*, 26*c*, 26*d* may have a dual-wall configuration. With reference to FIG. 2D and FIG. 3, a sidewall 26*a*, 26*b*, 26*c*, 26*d* having a dual wall configuration includes a first interior wall 32 and a second exterior wall 34 separated from one another. It should be appreciated that the interior wall 32 may define the interior 28 of a respective sidewall 26*a*, 26*b*, 26*c*, 26*d* and an exterior wall 34 may define the exterior 30 of a respective sidewall 26*a*, 26*b*, 26*c*, 26*d* in a dual wall configuration. The ends of the interior and exterior walls 32, 34 of a sidewall 26*a*, 26*b*, 26*c*, 26*d* may be connected to one another such that an enclosed environment 36 is formed between the interior and exterior walls 32, 34. In such embodiments, the environment 36 between a respective interior and exterior wall 32, 34 may be designed to limit heat transfer therebetween. For example, the environment 36 between the interior and exterior walls 32, 34 of a sidewall 26*a*, 26*b*, 26*c*, 26*d* may include a chamber of gas, such as pressurized gas, to enhance performance of insulation. Alternatively, a vacuum may be formed between the interior and exterior walls 32, 34 to restrict heat transfer between the interior and exterior walls 32, 34, respectively. In other embodiments, the enclosed environment 36 formed between the interior and exterior walls 32, 34 includes an insulative insert or a phase change material. In such embodiments where a physical element is positionable within the environment 36, the element may provide strength and rigidity to at least one of the adjacent interior and exterior walls 32, 34. In other embodiments, the cooler 20 may include removable inserts containing a phase-change material. These inserts may be pre-conditioned, such as frozen or pre-warmed, outside of the cooler 20 prior to placement within a respective chamber (to be described in more detail below) or between the dual walls, thereby maintaining desired temperature conditions.

It should be appreciated that the dual-walled configuration is intended as an example only and that any configuration of the cooler body 22 having a thermal insulating element incorporated thereinto is within the scope of the disclosure. In an embodiment, a surface of a sidewall 26*a*, 26*b*, 26*c*, 26*d*, such as an interior surface 28 for example, may include a thermally insulating coating to restrict heat transfer through the sidewall. In embodiments where a sidewall has a dual-wall configuration the interior wall 32 of a dual-walled sidewall 26*a*, 26*b*, 26*c*, 26*d* may be formed from a thermally insulating material to limit heat transfer at the cooler.

Alternatively, or in addition, the cooler 20 may include a refrigeration system for actively removing heat from the interior of the cooler body 22, such as a thermionic refrigeration system for example. This may be particularly useful for a line crew working in extreme temperatures with a line truck that has a supply of electricity for other equipment in use. It should be appreciated that the cooler body 22 may be designed to have different thermal insulative properties at different regions thereof. As will be described in more detail below, the cooler body may include a plurality of chambers, and the insulative properties associated with each of the plurality of chambers may be the same, or may vary, so as to accommodate different degrees of cooling required.

In some embodiments, the cooler body 22 includes anti-microbial properties, such as an anti-microbial material. The anti-microbial material may be integrally formed with the cooler body, such as with the sidewalls 26*a*, 26*b*, 26*c*, 26*d* or the bottom wall 24 for example, or alternatively may be applied as a coating over the interior surface of one or more of the sidewalls 26*a*, 26*b*, 26*c*, 26*d* or the bottom wall 24. Inclusion of an anti-microbial material may reduce the risk of microbial growth and contamination, thereby further enhancing the hygiene and sanitation of the cooler inside.

An upper surface 25 of the bottom wall 24 and the interior surface 28 of each sidewall 26*a*, 26*b*, 26*c*, 26*d* of the cooler body 22, in combination, define a hollow interior 60 of the cooler body 22. As noted above, a shape of the hollow interior 60 may be the same or may be different than the exterior shape of the cooler body 22. The hollow interior 60 may be divided into a plurality of chambers. In the illustrated, non-limiting embodiment of FIGS. 1A-1B, 3, and 4, the hollow interior 60 is divided such that the cooler body 22 has three separate chambers. The plurality of chambers within the hollow interior 60 may be formed by positioning one of more dividers within the hollow interior. As shown, a first divider 64*a* and a second divider 64*b* may be arranged within the hollow interior 60 to form the three separate chambers 62*a*, 62*b*, 62*c*. In an embodiment, the plurality of chambers are fluidly separated by a plurality of dividers 64*a*, 64*b*. It should be appreciated that a hollow interior 60 including any number of chambers is within the scope of the disclosure.

The plurality of chambers 62*a*, 62*b*, 62*c* may be substantially identical, or alternatively, may vary in size and/or shape. The dividers 64*a*, 64*b* may be removably positionable within the hollow interior 60, or alternatively, may be permanently mounted therein. In an embodiment, a divider 64*a*, 64*b* is integrally formed with the bottom wall 24 and/or at least one of the sidewalls 26*a*, 26*b*, 26*c*, 26*d* of the cooler body 22. Although the dividers 64*a*, 64*b* are illustrated as extending between the front wall 26*a* and rear wall 26*b* of the cooler body 22, embodiments where the dividers 64*a*, 64*b* extend between the first and second lateral sidewalls 26*c*, 26*d*, and embodiments where the dividers 64*a*, 64*b* extend between two adjacent sidewalls 26*a*, 26*b*, 26*c*, 26*d* of the cooler body 22 are also within the scope of the disclosure. In other embodiments, such as shown in FIG. 4, the hollow interior 60 may be a single chamber and a plurality of containers, such as a first container 66*a*, a second container 66*b*, and a third container 66*c* for example, each having their own hollow interior or chamber 68*a*, 68*b*, 68*c* are removably positionable within the hollow interior 60 to define separate areas therein.

In embodiments where the cooler 20 has three chambers, or more than three chambers, a first chamber 62*a* of the cooler 20 may be considered a drinking chamber. In an embodiment, the drinking chamber provides a volume for maintaining a supply of a drink, such as water or a sports drink. A second chamber 62*b* of the cooler 20 may be considered a cooling chamber that provides a volume for separately maintaining fungible goods such as snacks, lunch, other drinks. A third chamber 62*c* of the cooler 20 is a rewetting chamber that provides a volume for receiving garments and other apparatus used to wick heat away when applied to an individual. Examples include wetted headbands, towels, shirts, sleeves, hats, helmet liners and other such devices. A cooler having a drinking chamber, a cooling chamber, and a rewetting chamber may be referred to as "Chill Casa" or "Chill House." Further, in embodiments including a drinking chamber, a cooling chamber, and a rewetting chamber, each of the chambers 62*a*, 62*b*, 62*c* may be clearly labeled or identified to prevent confusion and incorrect use of one of the chambers, such as drinking form the rewetting chamber. It should be appreciated that the contents of the first chamber 62*a* and the second chamber 62*b*, such as the drinking chamber and the cooling chamber for example, may be shared between a plurality of users. However, the third chamber 62*c*, such as the rewetting chamber for example, may be intended for personal use to minimize hygienic risk.

An end of the hollow interior 60, opposite the bottom wall 24, may be open and exposed to the environment. Accordingly, an upper end 70*a*, 70*b*, 70*c* of each chamber 62*a*, 62*b*, 62*c* of the hollow interior 60 may be considered to be open. In an embodiment, the cooler 20 includes at least one lid movably or removably connectable to the cooler body 22 to selectively close the open end 46 of the hollow interior 60. Although not shown, a single lid may cover the entirety of the open upper end 70*a*, 70*b*, 70*c* of each of the plurality of chambers 62*a*, 62*b*, 62*c* associated with the hollow interior 60. In other embodiments, a corresponding lid 72*a*, 72*b*, 72*c* is connectable with each respective chamber 62*a*, 62*b*, 62*c*. In the illustrated, non-limiting embodiment, such as shown in FIGS. 1A-1B and 3-5, the hollow interior 60 of the cooler body 22 includes a first chamber 62*a*, a second chamber 62*b*, and a third chamber 62*c*, and the cooler includes a first lid 72*a* positionable at the open end 70*a* of the first chamber 62*a*, a second lid 72*b* positionable at the open end 70*b* of the second chamber 62*b*, and a third lid 72*c* positionable at the open end 70*c* of the third chamber 62*c*.

Figure 4:
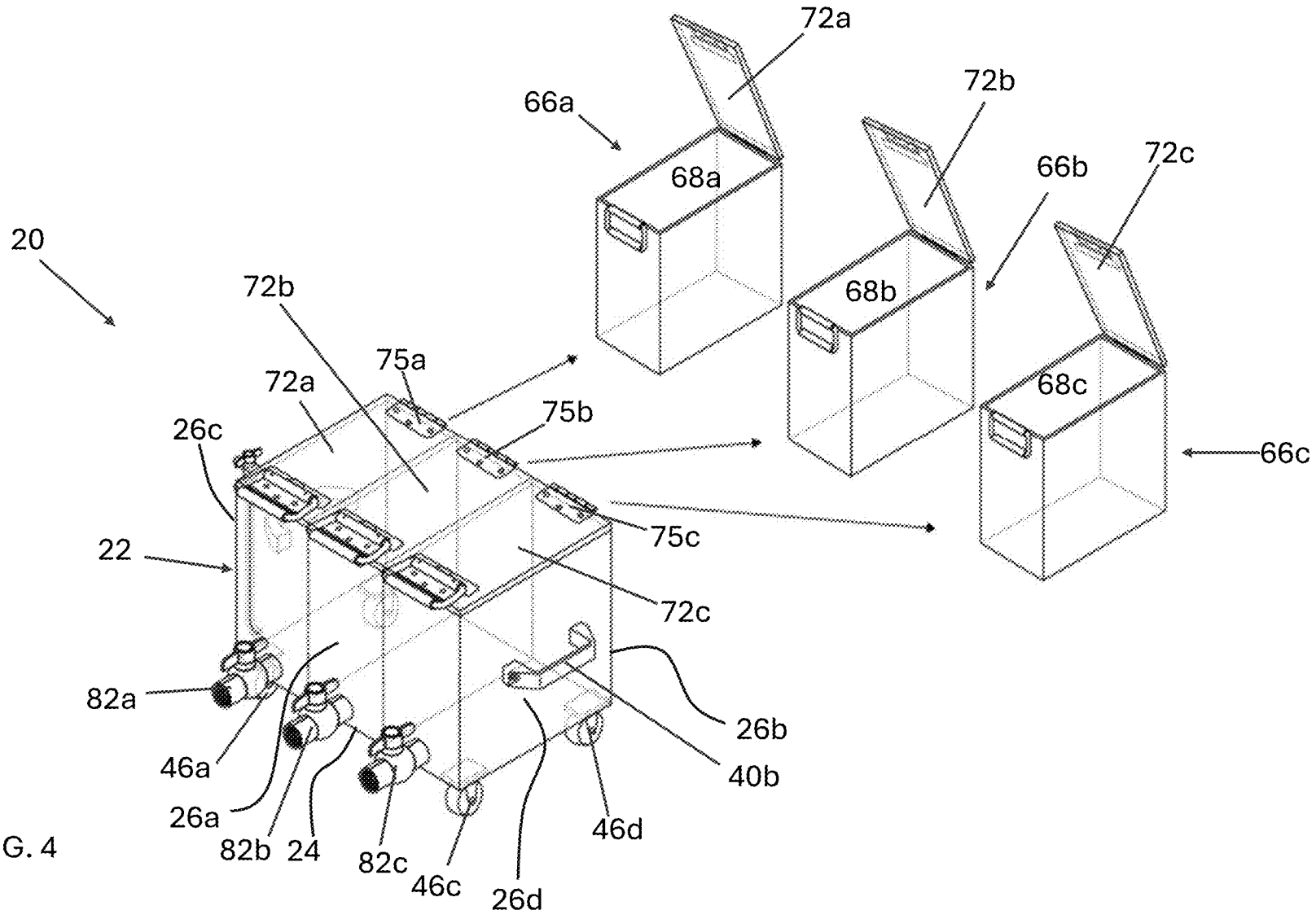
FIG. 4 is a perspective view of a cooler having a plurality of separate containers installable within a hollow interior of a cooler body.

The three lids 72*a*, 72*b*, 72*c* are transformable between a first, closed position (FIG. 1A) and a second, open position (FIG. 4). In the closed position, each lid overlaps 72*a*, 72*b*, 72*c* the open end 46 of a respective chamber 62*a*, 62*b*, 62*c*. In the open position, each lid 72*a*, 72*b*, 72*c* is spaced away from the open end 46 of a respective chamber, such that the open end 46 of the chamber is exposed and accessible by a user. As shown, in an embodiment, each of the plurality of lid 72*a*, 72*b*, 72*c* is mounted via a hinge 75*a*, 75*b*, 75*c* to the cooler body 22, such as to a sidewall 26*a*, 26*b*, 26*c*, 26*d* thereof. In such embodiments, each lid 72*a*, 72*b*, 72*c* may be rotatable between the closed and open positions about a horizontally oriented hinge axis. Accordingly, a user may access a respective chamber 62*a*, 62*b*, 62*c* of the cooler 20 by lifting the lid 72*a*, 72*b*, 72*c* and rotating it about its axis in a backwards direction. In some embodiments, each lid 72*a*, 72*b*, 72*c* is removably connectable to the cooler 20 at a position overlapping the open end 70*a*, 70*b*, 70*c* of a respective chamber 62*a*, 62*b*, 62*c*. Each lid 72*a*, 72*b*, 72*c* may be decoupled from the cooler body 22, such as moved to a position located remotely from the cooler 20 for example, to provide access to a respective chamber 62*a*, 62*b*, 62*c* of the cooler 20. It should be appreciated that any or all of the lids 72*a*, 72*b*, 72*c* may have a handle, notch, or other feature intended to facilitate a user's grasp and manipulation of the lid relative to the cooler body 22.

The plurality of lids 72*a*, 72*b*, 72*c* may have similar configurations or different configurations, and therefore may move relative to the cooler body 22 between the open position and the closed position in the same way or in different ways. Each of the plurality of lids 72*a*, 72*b*, 72*c* may be independently movable relative to the cooler body 22 between the closed position and the open position. Alternatively, one of the plurality of lids 72*a*, 72*b*, 72*c* may be coupled to an adjacent lid 72*a*, 72*b*, 72*c* such that moving one lid 72*a*, 72*b*, 72*c* toward the open position effectively opens two lids 72*a*, 72*b*, 72*c*.

When a lid 72*a*, 72*b*, 72*c* is in the closed position relative to a corresponding chamber 62*a*, 62*b*, 62*c*, the contents of a chamber 62*a*, 62*b*, 62*c* are contained within the chamber 62*a*, 62*b*, 62*c*. In some embodiments, one or more of the lids 72*a*, 72*b*, 72*c* is additionally configured to form a seal with the cooler body 22 such that the lid in the closed position, not only closes the open end of a chamber, but also seals the interior of the chamber. For example, a first lid 72*a* in the closed position may seal the first chamber 62*a*, a second lid 72*b* in the closed position may seal the second chamber 62*b*, and a third lid 72*c* in the closed position may seal the third chamber 62*c*. When a chamber 62*a*, 62*b*, 62*c* thereof is sealed, the contents of the chamber 62*a*, 62*b*, 62*c* are not flowable to or in fluid communication with the ambient atmosphere surrounding the cooler body 22.

Each lid 72*a*, 72*b*, 72*c* may be retained in the closed position in any suitable manner. In some embodiments, the lid 72*a*, 72*b*, 72*c* is frictionally engageable with a corresponding chamber 62*a*, 62*b*, 62*c* of the hollow interior 60, such as via a gasket or other friction material 73*a*, 73*b*, 73*c* (see FIG. 7) for example, to retain the lid in the closed position. The frictional engagement between the friction material of the lid 72*a*, 72*b*, 72*c* and the corresponding surfaces of the chamber 62*a*, 62*b*, 62*c* may form a seal, as described above, that aids in maintaining the environment within a corresponding chamber 62*a*, 62*b*, 62*c*.

In other embodiments, a latch or locking mechanism 74*a*, 74*b*, 74*c* is usable to retain one or more of the lids 72*a*, 72*b*, 72*c* in the closed position. It should be appreciated that a respective locking mechanism 74*a*, 74*b*, 74*c* may be associated with each lid 72*a*, 72*b*, 72*c*, and therefore the number of locking mechanisms 74*a*, 74*b*, 74*c* will vary with the number of lids 72*a*, 72*b*, 72*c*. In such embodiments, a first member 76*a*, 76*b*, 76*c* of the locking mechanism 74*a*, 74*b*, 74*c* may be arranged at the lid 72*a*, 72*b*, 72*c* and a second member 78*a*, 78*b*, 78*c* of each locking mechanism 74*a*, 74*b*, 74*c* may be arranged at an adjacent sidewall 26*a*, 26*b*, 26*c*, 26*d*. When a lid 72*a*, 72*b*, 72*c* is in the closed position, the first member 76*a*, 76*b*, 76*c* and the second member 78*a*, 78*b*, 78*c* may be engaged or may cooperate to restrict separation of the first member 76*a*, 76*b*, 76*c* from the second member 78*a*, 78*b*, 78*c*. Examples of such a locking mechanism 74*a*, 74*b*, 74*c* include but are not limited to, hook and loop fasteners, a cam lock, a lock with a flip closure, magnets, and snaps for example.

In some embodiments, such as where the lid 72*a*, 72*b*, 72*c* is coupled to the cooler body 22 in both the closed position and the open position, the lid 72*a*, 72*b*, 72*c* may be automatically biased toward the closed position. A lid 72*a*, 72*b*, 72*c* may be biased towards the closed position, such as via a biasing mechanism (not shown) arranged at a hinge axis, or by forming the lid 72*a*, 72*b*, 72*c* with an increased weight at a portion of the lid 72*a*, 72*b*, 72*c* distal from the hinge axis or connection with a 26*a*, 26*b*, 26*c*, 26*d* of the cooler body 22.

Figure 12:
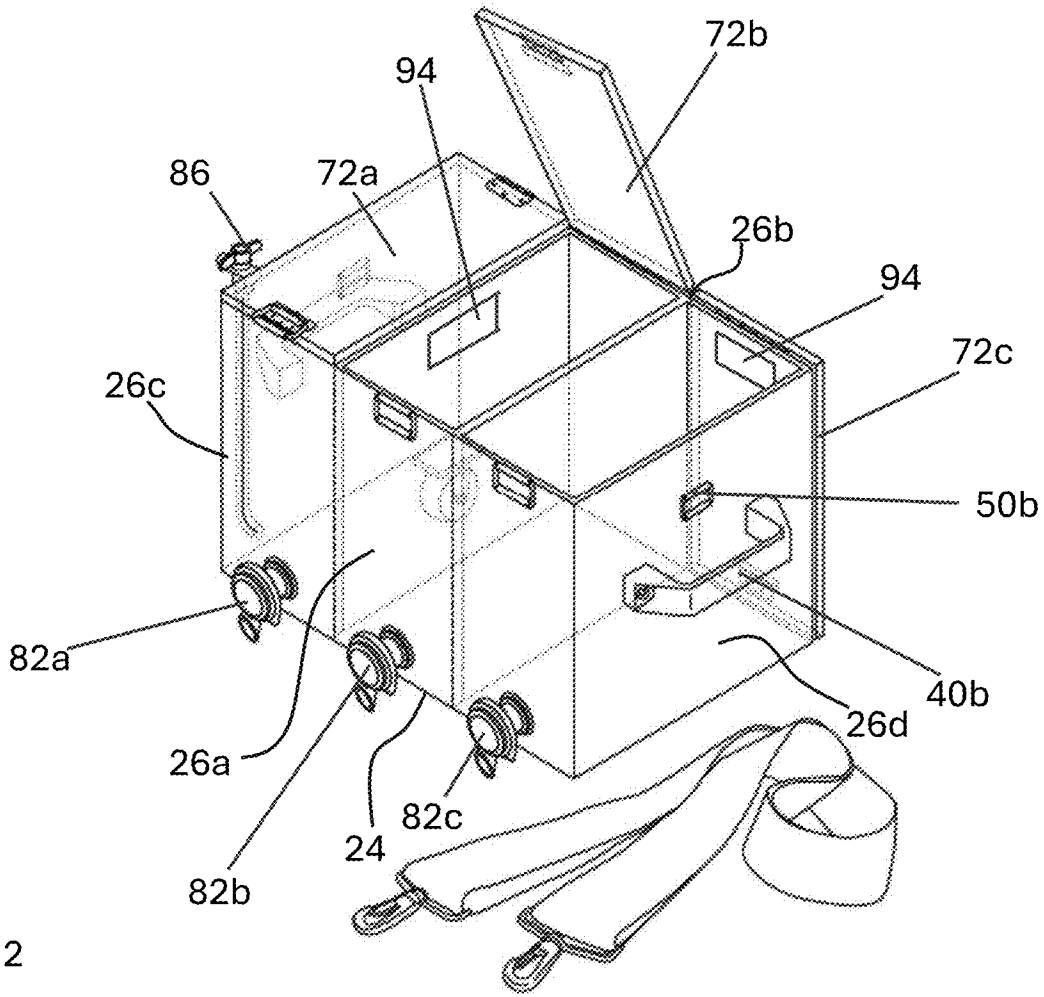
FIG. 12 is a perspective view of a cooler having a plurality of mounting features and a mounting strap.

At least one of the lids 72*a*, 72*b*, 72*c*, such as the lid associated with the rewetting chamber for example, may include one or more hooks 92 (see FIG. 4). A user may hang items that have been rewetted on these hooks 92. One or more illumination devices 94 (FIG. 12), such as including a light emitting diode for example, may be arranged at the cooler 20. An illumination device 94 may be positioned to illuminate a corresponding chamber 62*a*, 62*b*, 62*c* of the cooler 20. The illumination device 94 may be arranged at an interior surface of the chamber 62*a*, 62*b*, 62*c*, at an adjacent surface of the lid 72*a*, 72*b*, 72*c*, or at another suitable position about the cooler 20. In an embodiment, the operation of the illumination device 94 may be controlled based on a position of the lid 72*a*, 72*b*, 72*c* of the respective chamber 62*a*, 62*b*, 62*c*. For example, when the lid 72*a*, 72*b*, 72*c* of a chamber 62*a*, 62*b*, 62*c* having an illumination device 94 is closed, the illumination device 94 may not be energized, and when the lid 72*a*, 72*b*, 72*c* of a chamber 62*a*, 62*b*, 62*c* having an illumination device 94 is open, the respective illumination device 94 may be energized. Alternatively, or in addition, the one or more illumination devices 94 of the cooler 20 may be controlled manually.

With reference to FIGS. 6 and 7, in an embodiment, the cooler 20 includes a cover 80 separate from the plurality of lids 72*a*, 72*b*, 72*c*. In such embodiments, the cover 80 is movable between a first, closed cover position (shown) and a second, open cover position (not shown) to selectively access the plurality of lids 72*a*, 72*b*, 72*c*. In the closed position, the cover 80 is positionable in overlapping arrangement with the plurality of lids 72*a*, 72*b*, 72*c*. The cover 80 may be closely fitted to the plurality of lids lid 72*a*, 72*b*, 72*c* such that when the cover 80 is in the closed position, the plurality of lids 72*a*, 72*b*, 72*c* are restricted from moving relative to the cooler body 22. In such embodiments, the plurality of lids 72*a*, 72*b*, 72*c* may be movable relative to the cooler body 22 only when the cover 80 is in an open position or when the cover 80 is transforming from a closed position to an open position. To access a chamber 62*a*, 62*b*, 62*c*, a user first transforms the cover 80 to the open cover position. Upon separation of the cover 80, a user has access to the plurality of lids 72*a*, 72*b*, 72*c* and is free to move one of the plurality of lids 72*a*, 72*b*, 72*c*, such as a frictionally engaged lid for example, from a corresponding chamber 62*a*, 62*b*, 62*c*.

The cover 80 may be movable relative to the cooler body 22 independently from the plurality of lids 72*a*, 72*b*, 72*c* and in some embodiments, may be movable with at least one of the plurality of lids 72*a*, 72*b*, 72*c*. The cover 80 may be rotatably connected to the cooler body 22, such as via a hinge similar to hinges 75*a*, 75*b*, 75*c* for example, or may be separable from the cooler body 22 to transform between the closed position and the open position. However, it should be appreciated that embodiments that do not include a cover 80 are also contemplated herein.

Figure 14:
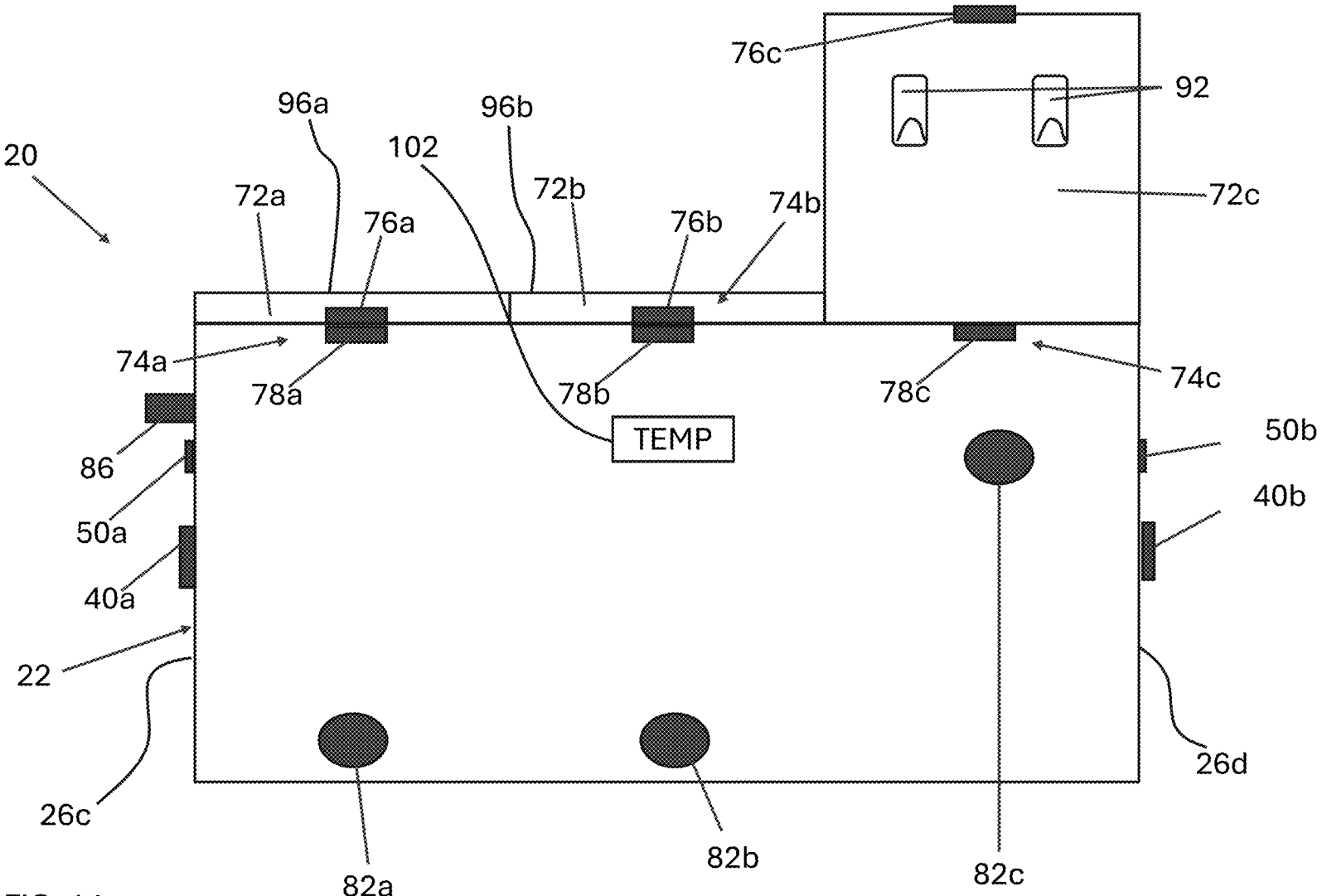
FIG. 14 is a front view of a cooler having the lid of a rewetting chamber open according to an embodiment.

In an embodiment, one or more of the lids 72*a*, 72*b*, 72*c*, when in the closed position provides a seat for a user. In some embodiments, the upper surfaces 96*a*, 96*b*, 96*c* of two or more adjacent lids 72*a*, 72*b*, 72*c* are flush when in the closed position (see FIG. 14) such that the two or more lids 72*a*, 72*b*, 72*c*, in combination, form a seat. The upper surface 96*a*, 96*b*, 96*c* of a lid 72*a*, 72*b*, 72*c* in the closed position, or the upper surfaces 96*a*, 96*b*, 96*c* of two or more adjacent lids 72*a*, 72*b*, 72*c* in the closed position may have a generally horizontal orientation. Alternatively, or in addition, the cover 80 when in the closed cover position, may function as a seat (FIG. 7). In such embodiments, the upper surface 98 of the cover 80 in the closed cover position may have a generally horizontal orientation.

Figure 15:
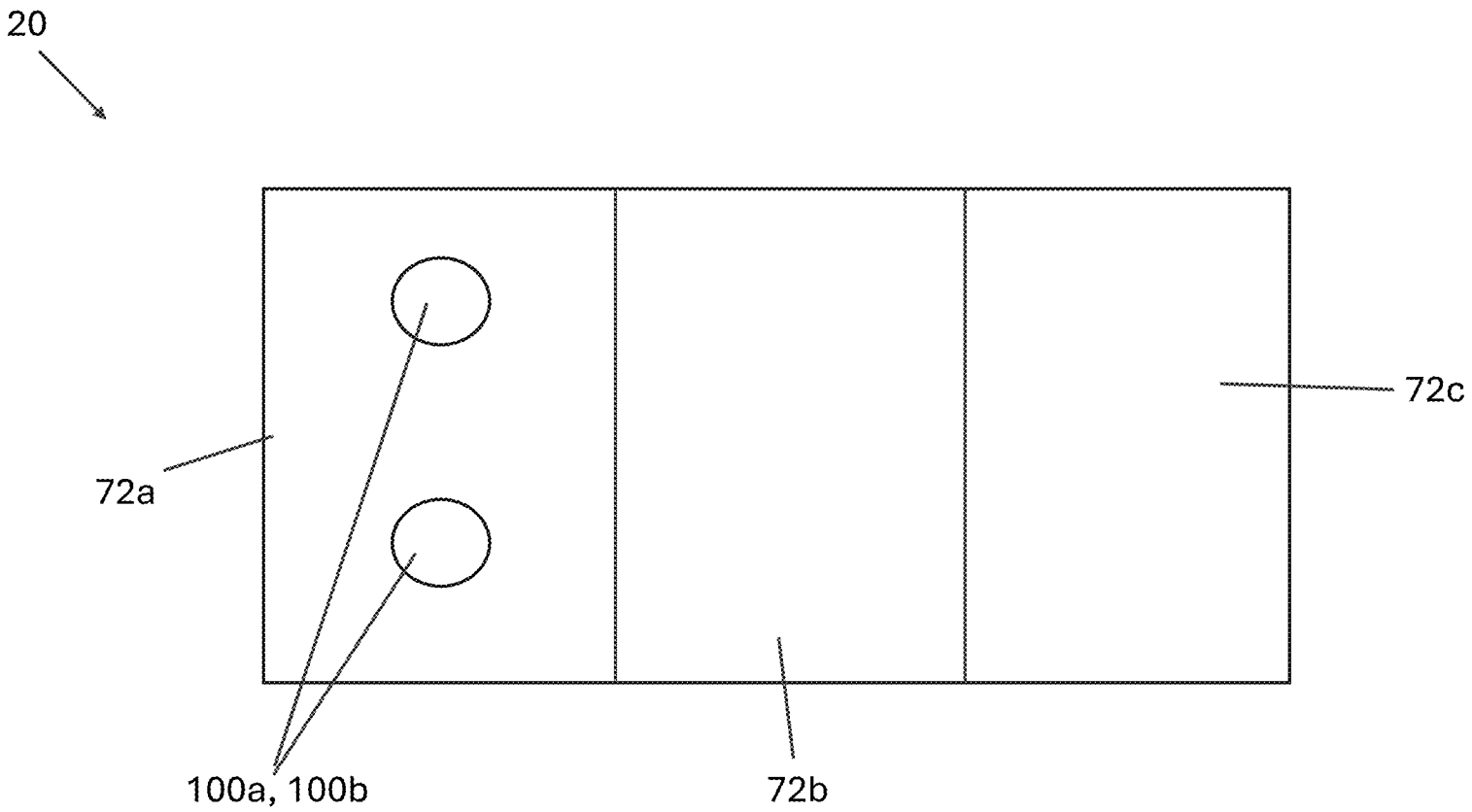
FIG. 15 is a plan view of a cooler according to an embodiment.

In an embodiment, the cooler 20 provides a support for one or more of a user's accessories. For example, the cooler 20 may provide one or more cup holders. In the illustrated, non-limiting embodiment, shown in FIG. 15, one of the plurality of lids 72*a*, 72*b*, 72*c* of the cooler 20 has a first recess 100*a* for receiving a cup, bottle, or other container and a second recess 100*b* for receiving another cup, bottle, or other container therein. When the lid 72*a*, 72*b*, 72*c* is in a closed position, the upper surface 96*a*, 96*b*, 96*c* of the lid 72*a*, 72*b*, 72*c* is oriented generally horizontally, such that a drink or other item may be supported in the first and/or second recess 100*a*, 100*b*. Although the recesses 100*a* and 100*b* are illustrated as being formed at lid 72*a*, it should be appreciated that one or more recesses may be formed at any of the plurality of lids 72*a*, 72*b*, 72*c*. Further, it should be appreciated that in embodiments of the cooler 20 including a cover 80, the at least one cup holder may be formed in the cover 80. In other embodiments, the cooler may include a modular attachment system that allows for removably connection of various accessories, such as cup holders for example, to the cooler 20.

In an embodiment, the cooler includes a temperature indicator 102 (FIG. 6), such as arranged at an exterior of the cooler body 22 for example. The temperature indicator 102 may visually indicate the internal temperature of one or more of the chambers 62*a*, 62*b*, 62*c* of the cooler 20. Exemplary temperature indicators include but are not limited to a thermometer and a digital display. In an embodiment, a controller is operably coupled to the temperature indicator 102 and to at least one temperature sensor (not shown) configured to communicate a sensed internal temperature to the controller. The controller may be configured to communicate with a portable device located remotely from the cooler, such as a smartphone or laptop for example, via an application or program for example. In such instances, the controller may be operable to generate a notification when the temperature within a chamber 62*a*, 62*b*, 62*c* exceeds or falls below a predetermined threshold.

Figure 8:
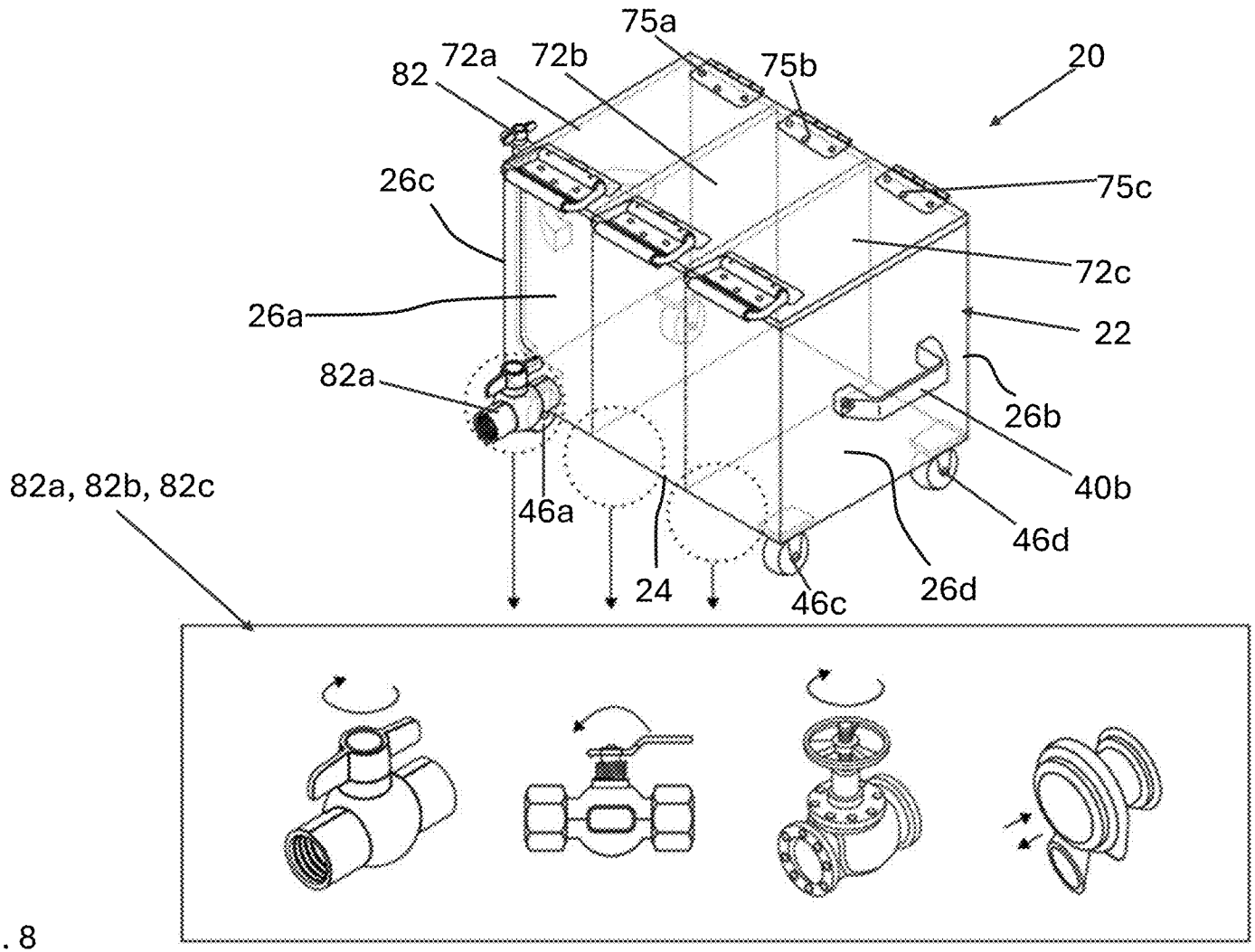
FIG. 8 is a perspective view of a cooler having a plurality of dispensing mechanism.

One or more access mechanisms may be fluidly connected to or associated with a chamber 62*a*, 62*b*, 62*c* of the cooler body 22. In an embodiment, a respective access mechanism may be associated with each separate chamber 62*a*, 62*b*, 62*c* of the cooler body 22. However, embodiments where only some of the chambers 62*a*, 62*b*, 62*c* have an access mechanism associated therewith are also within the scope of the disclosure. One type of access mechanism may include a form of plumbing fluidly connectable to a chamber 62*a*, 62*b*, 62*c* such as a dispensing mechanism 82*a*, 82*b*, 82*c*. For example, as shown in FIGS. 1A, 1B, 6, and 8, a dispensing mechanism 82*a*, 82*b*, 82*c* may be a spigot, faucet, push button valve, push handle valve, gate valve, or any other suitable device operable to dispense a fluid from within a chamber 62*a*, 62*b*, 62*c* while remaining fluidly connected to the chamber 62*a*, 62*b*, 62*c*. While the dispensing mechanisms 82*a*, 82*b*, 82*c* are generally illustrated as being located near a bottom 24 of the cooler 20, it should be appreciated that embodiments where one or more dispensing mechanisms 82*a*, 82*b*, 82*c* are located at a raised positioned are also within the scope of the disclosure. For example, as illustrated in FIG. 8, dispensing mechanism 82*b* is offset from the bottom wall 24, such as at a location near the lid 72*b*. Positioning of a dispensing mechanism remotely from the bottom 24 provides a greater clearance for receipt of a vessel, such as a water bottle or cup, vertically beneath the dispensing mechanism. In such instances, the cooler 20 may incorporate a mechanism (not shown) for drawing liquid from near a bottom of the hollow interior of a chamber 62*a*, 62*b*, 62*c* to the dispensing mechanism 82*a*, 82*b*, 82*c*. Examples of suitable mechanisms include, but are not limited to a pumping mechanism, a straw, a siphon, and a pressurization mechanism for pressurizing the hollow interior 60 of the chamber 62*a*, 62*b*, 62*c*. The pressurization mechanism may include a hand-operated plunger pump, or pressurizable air bladder configured to inflate through a bicycle-type valve.

Another type of access mechanism associated with a chamber 62*a*, 62*b*, 62*c* of the cooler 20 may include a drain 84 having a drain through hole and a corresponding drain plug receivable within the drain through hole to selectively block a flow of fluid through the drain through hole. The drain 84 is removable from the cooler body 22 to form a flow path through which fluid may exit from a chamber 62*a*, 62*b*, 62*c*. In the non-limiting embodiment illustrated in FIG. 7, a drain 84 is shown being formed in the bottom wall 24. However, it should be appreciated that a drain 84 may alternatively be arranged at any of the sidewalls 26*a*. 26*b*, 26*c*, 26*d*. Further, although only a single drain 84 is illustrated, embodiments where some or all of the chambers 62*a*, 62*b*, 62*c* of the cooler 20 include a drain 84 are contemplated herein. In an embodiment, each of the plurality of chambers 62*a*, 62*b*, 62*c* includes a respective drain 84.

Yet another type of access mechanism includes an inlet port 86 fluidly connectable to a fluid source (not shown) separate from the cooler 20. In such embodiments, a fluid may be delivered to a chamber, such as chamber 62*a* for example, via the inlet port 86 without removing the lid 72*a*, 72*b*, 72*c* therefrom. Although an inlet port 86 is only illustrated at being fluidly connected to the first chamber 62*a*, it should be appreciated that any or all of the chambers 62*a*, 62*b*, 62*c* may have an inlet port 86 fluidly connected thereto. Any type of inlet port having supply lines connectable to an external connection or fluid source to receive a fluid therefrom are within the scope of the disclosure. In an embodiment, a chamber 62*a*, 62*b*, 62*c* of the cooler 20 is connectable to an inlet port to a water supply to fill at least one of the chambers, such as the drinking chamber and the rewetting chamber for example. Inclusion of one or more access mechanisms, such as a dispensing mechanism 82*a*, 82*b*, 82*c*, and inlet port 86 and/or a drain 84 may be particularly useful for flushing the cooler 20 after use. It should be appreciated that a chamber 62*a*, 62*b*, 62*c* of the cooler 20 may have no access mechanisms associated therewith or may have any combination of the various types of access mechanisms described herein.

Figure 5:
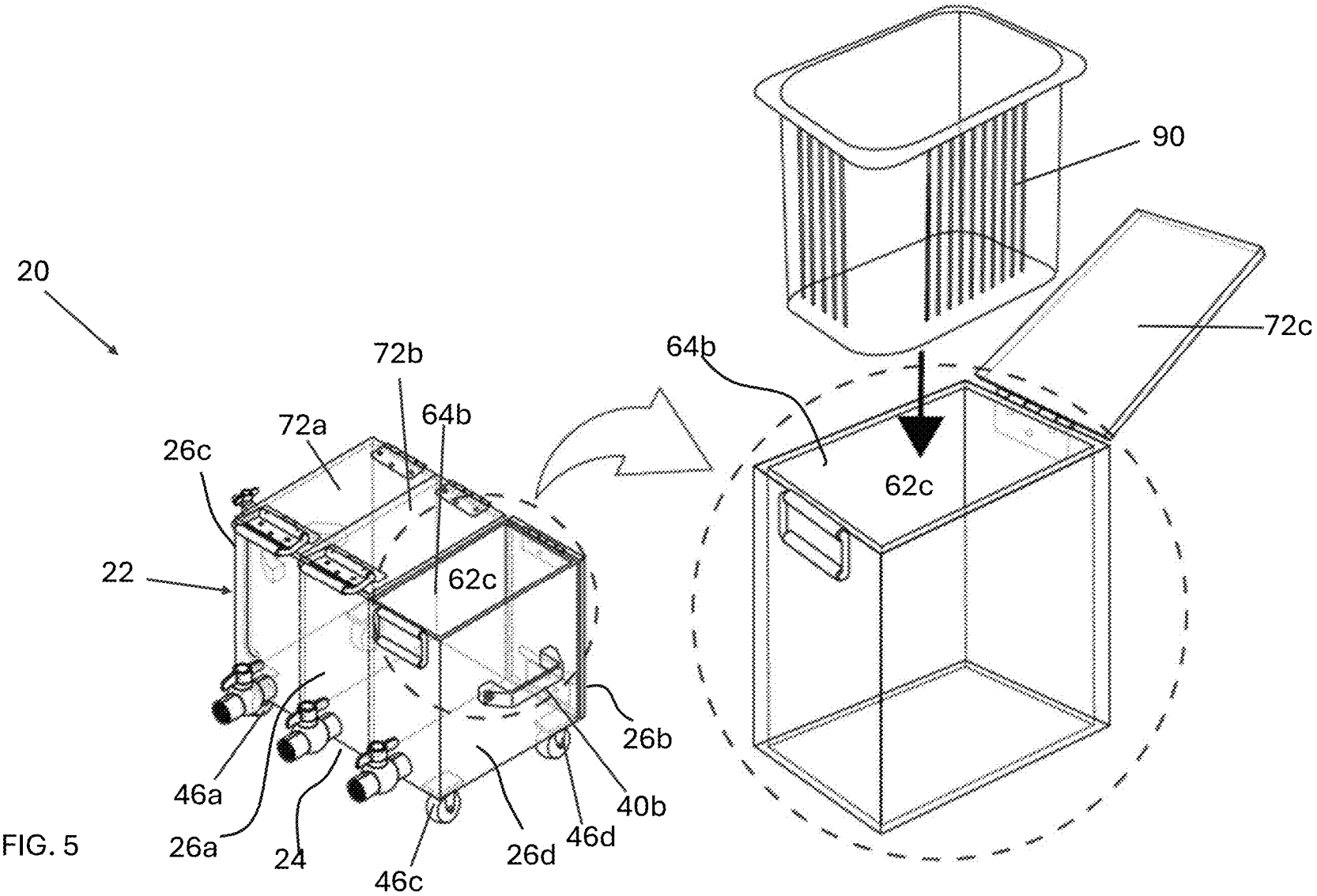
FIG. 5 is a perspective view of a cooler having a liner positionable within a chamber of the cooler body.

With reference to FIG. 5, in an embodiment, at least one liner 90, such as a disposable liner for example, is removably receivable within one or more of the chambers 62*a*, 62*b*, 62*c* of the cooler 20. For example, a disposable liner 90 may be placed within a corresponding chamber, such as in the rewetting chamber, prior to filling. Use of a liner 90 and the frequent cleaning and/or replacement thereof may enhance the hygiene and sanitary conditions of the cooler 20. This may be particularly useful in environments where a supply of coolers 20 is provided by an employer, and different work crews make use of the same equipment (such as a line truck). In some embodiments, a liner 90 is a rigid bin or a flexible disposable bag and may include integral lifting tabs configured to allow the entire liner to be easily removed from the cooler 20 as a single pod.

A cooler as described herein may be provided in a variety of sizes. It should be appreciated that the size of the cooler can be varied based on need. For example, a cooler intended for use for during a twelve-hour shift would likely be bigger than a cooler intended for use by an athlete during a two-hour practice. Accordingly, some of the features described herein may be particularly valuable for some embodiments while unrelated to others. For example, it is recognized a detachable shoulder strap will not be particularly useful for a large heavy cooler that is transported via wheels.

Further, the cooler may be configured with any of a variety of colors. For example, the cooler may be provided in team or company colors. The cooler may be configured with elements of a particular brand. For example, the cooler may be embossed with, at least partially shaped like or otherwise exhibited aspects of a brand. Aspects of the brand may include versions of a logo, a mascot, or other such appearances.

A cooler 20 as described herein may support multiple needs of people performing physical activity in a heated environment, such as athletes who practice or compete in the heat, laborers who have long workdays in the heat, and kids at summer camp, for example. First, the cooler 20 may provide a source of cold hydration for a user such as during a work day or training. Second, the cooler 20 may provide a cold-water reservoir in which cooling products, such as cooling towels, arm sleeves, hats, gaiters, helmet liners, bandanas, etc., may be repeatedly rewetted or reactivated during the activity being performed. Third, the cooler 20 may provide a dry, chilled area that individuals can place filled water bottles, sports drinks, fruits, snacks, or other items. The cooler 20 may be used by an individual or alternatively, by a plurality of people, such as teammates or coworkers. A cooler as described herein is easily portable and transportable making the cooler 20 suitable for use in many different outdoor applications.

All statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Various other components may be included and called upon for providing for aspects of the teachings herein. For example, additional materials, combinations of materials and/or omission of materials may be used to provide for added embodiments that are within the scope of the teachings herein. Adequacy of any particular element for practice of the teachings herein is to be judged from the perspective of a designer, manufacturer, seller, user, system operator or other similarly interested party, and such limitations are to be perceived according to the standards of the interested party.

In the disclosure hereof any element expressed as a means for performing a specified function is intended to encompass any way of performing that function including, for example, a) a combination of circuit elements and associated hardware which perform that function or b) software in any form, including, therefore, firmware, microcode or the like as set forth herein, combined with appropriate circuitry for executing that software to perform the function. Applicants thus regard any means which can provide those functionalities as equivalent to those shown herein. No functional language used in claims appended herein is to be construed as invoking 35 U.S.C. § 112(f) interpretations as "means-plus-function" language unless specifically expressed as such by use of the words "means for" or "steps for" within the respective claim.

When introducing elements of the present invention or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements. The term "exemplary" is not intended to be construed as a superlative example but merely one of many possible examples.

What is claimed is:

1. A personal use cooler comprising:

a cooler body comprising three chambers, each of the chambers comprising an open end;

each of the chambers comprising a respective lid movable relative to the cooler body, wherein each of the chambers is sealed when the respective lid is in the closed position; and a drain for draining a respective one of the chambers;

wherein at least one of the chambers is patterned with a micropattern that reduces bacterial growth and is configured for personal use to minimize hygienic risk.

2. The personal use cooler of claim 1, wherein the cooler body includes a hollow interior and a plurality of dividers are arranged within the hollow interior to define the plurality of chambers.

3. The personal use cooler of claim 1, wherein at least one of the lids is pivotably coupled to the cooler body.

4. The personal use cooler of claim 1, wherein each of the lids is independently movable relative to the cooler body.

5. The personal use cooler of claim 1, further comprising a cover, the cover being positionable in overlapping arrangement with the lids in the closed position.

6. The personal use cooler of claim 1, further comprising at least one of a dispensing mechanism and an inlet port.

7. The personal use cooler of claim 1, further comprising a plurality of wheels coupled to the cooler body.

8. The personal use cooler of claim 1, further comprising at least one handle arranged at an exterior of the cooler body.

9. The personal use cooler of claim 1, further comprising at least one mounting feature and a strap, the strap being connectable to the at least one mounting feature.

10. The personal use cooler of claim 1, wherein the micropattern is disposed on an inner surface of a liner positionable within the at least one chamber.

11. A personal user cooler comprising:

a cooler body comprising three chambers, the three chambers being fluidly separate from one another;

each of the chambers comprising a respective lid movable relative to the cooler body, wherein each of the chambers is sealed when the respective lid is in the closed position;

wherein at least one of the chambers is patterned with a micropattern that reduces bacterial growth;

three drains, each of the drains for draining a respective one of the chambers; and an inlet port for filling a respective one of the chambers, the inlet port being fluidly connectable to an external fluid source.

12. The cooler of claim 11, wherein each of the lids is independently movable relative to the cooler body.

13. The cooler of claim 11, wherein at least one of the lids is pivotably coupled to the cooler body.

14. The cooler of claim 11, wherein at least one of the lids is removably connectable to the cooler body.

15. The cooler of claim 11, wherein each of the lids includes a gasket, the three chambers being sealed when each of the lids is in the closed position.

16. The cooler of claim 11, further comprising a plurality of wheels coupled to the cooler body.

17. The cooler of claim 11, further comprising at least one handle arranged at an exterior of the cooler body.

18. The cooler of claim 11, further comprising at least one mounting feature and a strap, the strap being connectable to the at least one mounting feature.

19. The cooler of claim 11, further comprising a disposable liner, the disposable liner being receivable within one of the three chambers.

20. A personal use cooler comprising:

a cooler body comprising three chambers;

each of the chambers comprising a respective lid and an open end of each of the chambers is sealable by the respective lid;

a drain for draining a respective one of the chambers;

wherein at least one of the chambers is configured with a removable liner patterned with a micropattern that reduces bacterial growth to minimize hygienic risk.

* * * * *